US009916920B2

(12) United States Patent
Morikami et al.

(10) Patent No.: US 9,916,920 B2
(45) Date of Patent: Mar. 13, 2018

(54) ROTARY VARIABLE RESISTOR AND METHOD FOR MANUFACTURING THE SAME

(71) Applicant: Murata Manufacturing Co., Ltd., Nagaokakyo-shi, Kyoto-fu (JP)

(72) Inventors: Masashi Morikami, Nagaokakyo (JP); Hiroyuki Kishishita, Nagaokakyo (JP); Takeshi Takeda, Nagaokakyo (JP); Osamu Nakao, Nagaokakyo (JP); Tomoyo Kitagawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/496,383

(22) Filed: Apr. 25, 2017

(65) Prior Publication Data

US 2017/0229220 A1 Aug. 10, 2017

Related U.S. Application Data

(63) Continuation of application No. PCT/JP2015/075800, filed on Sep. 11, 2015.

(30) Foreign Application Priority Data

Oct. 31, 2014 (JP) ..... 2014-223466
Mar. 31, 2015 (JP) ..... 2015-073203

(51) Int. Cl.
*H01C 10/32* (2006.01)
*H01C 17/065* (2006.01)
(Continued)

(52) U.S. Cl.
CPC ..... *H01C 10/32* (2013.01); *H01C 1/01* (2013.01); *H01C 1/142* (2013.01); *H01C 17/065* (2013.01)

(58) Field of Classification Search
CPC ..... H01C 10/32; H01C 1/01; H01C 1/142; H01C 17/065
(Continued)

(56) References Cited

U.S. PATENT DOCUMENTS 4,318,075 A * 3/1982 Pudelko ..... G01F 23/36 338/162
4,751,492 A * 6/1988 Tsuzuki ..... H01C 7/18 338/122
(Continued)

FOREIGN PATENT DOCUMENTS

JP 02-170403 A 7/1990
JP 2004-335543 A 11/2004
(Continued)

OTHER PUBLICATIONS

Official Communication issued in International Patent Application No. PCT/JP2015/075800, dated Dec. 8, 2015.

*Primary Examiner* — Kyung Lee
(74) *Attorney, Agent, or Firm* — Keating & Bennett, LLP

(57) ABSTRACT

A rotary variable resistor includes an insulating substrate, a resistor pattern and a current collector pattern that are provided on the insulating substrate, a rotor that is mounted on the insulating substrate in a rotatable manner, and a slider that is mounted on the rotor and makes sliding contact with the resistor pattern and the current collector pattern to cause the resistor pattern and the current collector pattern to be conducted to each other. When a maximum dimension of the resistor pattern, which defines a variable resistor, is Z [mm] and electric linearity is L [%], $Z \leq 4.0$ and $Z \times L < 10$ are satisfied.

17 Claims, 23 Drawing Sheets

(51) Int. Cl.
*H01C 1/01* (2006.01)
*H01C 1/142* (2006.01)

(58) Field of Classification Search
USPC ..... 338/162
See application file for complete search history.

(56) References Cited

U.S. PATENT DOCUMENTS 5,243,318 A * 9/1993 Greenstein ..... H01C 10/305
338/185
6,507,271 B2 * 1/2003 Taguchi ..... H01C 10/30
338/160
6,798,333 B1 * 9/2004 Morikami ..... H01C 10/34
338/162
7,583,177 B1 * 9/2009 Fan ..... H01C 10/32
338/162
7,619,501 B2 * 11/2009 Miura ..... H01C 10/345
338/162

FOREIGN PATENT DOCUMENTS

JP 2005-150275 A 6/2005
JP 2005-217207 A 8/2005
NO 2010/079692 A1 7/2010

* cited by examiner

ROTARY VARIABLE RESISTOR AND METHOD FOR MANUFACTURING THE SAME

CROSS REFERENCE TO RELATED APPLICATIONS

This application claims the benefit of priority to Japanese Patent Application No. 2014-223466 filed on Oct. 31, 2014 and Japanese Patent Application No. 2015-073203 filed on Mar. 31, 2015 and is a Continuation Application of PCT Application No. PCT/JP2015/075800 filed on Sep. 11, 2015. The entire contents of each application are hereby incorporated herein by reference.

BACKGROUND OF THE INVENTION

1. Field of the Invention

The present invention relates to a rotary variable resistor and a method for manufacturing the same.

2. Description of the Related Art

Japanese Unexamined Patent Application Publication No. 2-170403 discloses an existing rotary variable resistor. The rotary variable resistor includes a resin film, a resistor pattern and a current collector pattern that are provided on the resin film, and a slider that makes sliding contact with the resistor pattern and the current collector pattern. The resistor pattern and the current collector pattern are printed onto the resin film.

The above-described existing rotary variable resistor has a risk that reduction in size thereof causes electric linearity to be deteriorated. A reason for this is that the reduction in size reduces the resistor pattern in size to increase influence by variation in a film thickness of the resistor pattern, resulting in deterioration in the electric linearity. In particular, it has been discovered by the inventors of the present application that the deterioration in the electric linearity becomes significant when the resistor pattern is formed by printing.

SUMMARY OF THE INVENTION

Preferred embodiments of the present invention provide a rotary variable resistor and a method for manufacturing the same, which achieve a reduction in size and an increase in accuracy.

A rotary variable resistor according to a preferred embodiment of the present invention includes an insulating substrate; a resistor pattern and a current collector pattern that are provided on the insulating substrate and are separated from each other; a rotor that is mounted on the insulating substrate in a rotatable manner; and a slider that is mounted on the rotor so as to be rotatable together with the rotor and to make sliding contact with the resistor pattern and the current collector pattern to cause the resistor pattern and the current collector pattern to be conducted to each other, wherein when a maximum dimension of the resistor pattern, which defines a variable resistor, is Z [mm] and electric linearity is L [%], $Z \leq 4.0$ and $Z \times L < 10$ are satisfied.

The maximum dimension Z of the resistor pattern indicates, for example, a diameter thereof when an outer shape of the resistor pattern is a circular shape, or a long side thereof when the outer shape of the resistor pattern is a rectangular shape. The electric linearity L indicates a maximum vertical deviation of a measured output voltage ratio from an ideal straight line with respect to a relationship between a rotation angle of the rotor and the output voltage ratio.

With a rotary variable resistor according to a preferred embodiment of the present invention, the rotary variable resistor is able to be reduced in size because $Z \leq 4.0$ is satisfied. Furthermore, the electric linearity is able to be improved because $Z \times L < 10$ is satisfied. Accordingly, the rotary variable resistor is able to achieve both a reduction in size and an increase in accuracy.

In a rotary variable resistor according to a preferred embodiment, the resistor pattern and the current collector pattern are configured preferably by applying paste onto the insulating substrate by screen printing.

With a rotary variable resistor according to a preferred embodiment of the present invention, the resistor pattern and the current collector pattern are configured preferably by applying the paste onto the insulating substrate by the screen printing. Accordingly, the screen printing, which is the cheapest and effective, is preferably used, thus achieving reduction in cost.

A rotary variable resistor according to another preferred embodiment of the present invention includes an insulating substrate; a resistor pattern and a current collector pattern that are provided on the insulating substrate and are separated from each other; a rotor that is mounted on the insulating substrate in a rotatable manner; and a slider that is mounted on the rotor so as to be rotatable together with the rotor and makes sliding contact with the resistor pattern and the current collector pattern to cause the resistor pattern and the current collector pattern to be conducted to each other, wherein the resistor pattern is configured preferably by applying paste onto the insulating substrate in a first direction by screen printing, and when on a cross section that passes through a middle point of a width of the resistor pattern at a side at which a length of the resistor pattern in a direction perpendicular or substantially perpendicular to the first direction is maximum on a first straight line in parallel with the first direction and passing through a rotating axis of the rotor and is perpendicular or substantially perpendicular to the first straight line, a film thickness of a center portion is $t1$ and a maximum film thickness is $t2$, $1.0 \leq (t2/t1) < 1.2$ is satisfied.

The first direction herein indicates a printing direction and indicates a direction in which the paste is transported on a screen film by a squeegee.

With a rotary variable resistor according to a preferred embodiment of the present invention, variations in the film thickness of the resistor pattern are decreased or eliminated to improve the electric linearity because $1.0 \leq (t2/t1) < 1.2$ is satisfied. Accordingly, the rotary variable resistor reduced in size achieves an increase in accuracy.

The resistor pattern is preferably configured by applying the paste onto the insulating substrate by the screen printing. Accordingly, the screen printing, which is the cheapest and effective, is preferably used, thus achieving reduction in cost.

In a rotary variable resistor according to a preferred embodiment of the present invention, when a maximum dimension of the resistor pattern, which defines a variable resistor, is Z [mm] and electric linearity is L [%], $Z \leq 4.0$ and $Z \times L < 10$ are satisfied.

With the rotary variable resistor in the above-described preferred embodiment, the rotary variable resistor is able to be reduced in size because $Z \leq 4.0$ is satisfied. Furthermore, the electric linearity is able to be improved because $Z \times L < 10$ is satisfied. Accordingly, the rotary variable resistor achieves both a reduction in size and an increase in accuracy.

In a rotary variable resistor according to a preferred embodiment of the present invention, the resistor pattern and the current collector pattern are preferably made of the same material.

With the rotary variable resistor in the above-described preferred embodiment, the resistor pattern and the current collector pattern are preferably made of the same material, thus achieving a reduction in cost.

A rotary variable resistor according to a preferred embodiment of the present invention includes an exposed electrode that is provided in the insulating substrate and is exposed onto the insulating substrate; and an electrode pattern that is provided on the insulating substrate and is located between the resistor pattern and the exposed electrode, wherein the resistor pattern and the exposed electrode are conducted to each other with the electrode pattern interposed between the resistor pattern and the exposed electrode.

With a rotary variable resistor according to a preferred embodiment of the present invention, the resistor pattern and the exposed electrode are conducted to each other with the electrode pattern interposed therebetween. When it is difficult to cause the resistor pattern and the exposed electrode to be directly conducted to each other, the resistor pattern and the exposed electrode are able to be indirectly conducted to each other by interposing the electrode pattern therebetween, thus ensuring high reliability.

In a rotary variable resistor according to a preferred embodiment of the present invention, a rotor includes a main body made of resin; and a metal member fixed to the main body, and the slider is locked by the metal member and is mounted on the rotor.

With the rotary variable resistor according to the present preferred embodiment, the slider is locked by the metal member fixed to the main body and is mounted on the rotor, thus decreasing generation of rattling between the slider and the rotor due to reflow soldering heat. With this, contact pressures of the slider onto the resistor pattern and the current collector pattern do not fluctuate, thus providing stable contact between the resistor pattern and the current collector pattern.

In a rotary variable resistor according to a preferred embodiment of the present invention, the slider is locked by the metal member by bending and fixing of the metal member.

With a rotary variable resistor according to a preferred embodiment of the present invention, the slider is locked by the metal member by bending and fixing of the metal member, thus easily mounting the slider on the rotor.

In a rotary variable resistor according to a preferred embodiment of the present invention, the metal member is fixed to the main body by insert molding.

With a rotary variable resistor according to a preferred embodiment of the preferred embodiment, the metal member is fixed to the main body by the insert molding, thus the metal member is easily fixed to the main body.

A method for manufacturing a rotary variable resistor according to a still another preferred embodiment of the present invention includes arranging a screen film including holes, which correspond to a resistor pattern and a current collector pattern, on an insulating substrate so as to be separated from the insulating substrate; placing paste onto the screen film; and forming the resistor pattern and the current collector pattern on the insulating substrate by transporting the paste on the screen film in a first direction while pressing the screen film by a squeegee and pushing out the paste from the holes of the screen film, wherein in the pattern forming, the resistor pattern and the current collector pattern are formed on the insulating substrate while pressing the screen film by the squeegee so as to make the screen film contact with the insulating substrate.

With the method for manufacturing the rotary variable resistor according to the present preferred embodiment of the present invention, in the pattern forming, the resistor pattern and the current collector pattern are formed on the insulating substrate while pressing the screen film by the squeegee so as to make the screen film contact with the insulating substrate. In this manner, the resistor pattern and the current collector pattern are printed while sufficiently pressing the screen film by the squeegee, thus being able to control the thicknesses of the resistor pattern and the current collector pattern with the thicknesses of the holes of the screen film. Therefore, the thicknesses of the resistor pattern and the current collector pattern are able to be made constant or substantially constant regardless of the sizes of openings of the holes of the screen film. This enables variations in the film thickness of the resistor pattern to be decreased or prevented to improve electric linearity. Accordingly, even when a rotary variable resistor with a reduced size is manufactured, an increase in accuracy is able to be achieved.

Rotary variable resistors according to preferred embodiments of the present invention achieve a both of reduction in size and an increase in accuracy.

Methods for manufacturing rotary variable resistors according to preferred embodiments of the present invention manufacture rotary variable resistors that are reduced in size and increased in accuracy.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, the present invention will be described in detail by describing preferred embodiments with reference to the drawings.

First Preferred Embodiment

Figure 1:
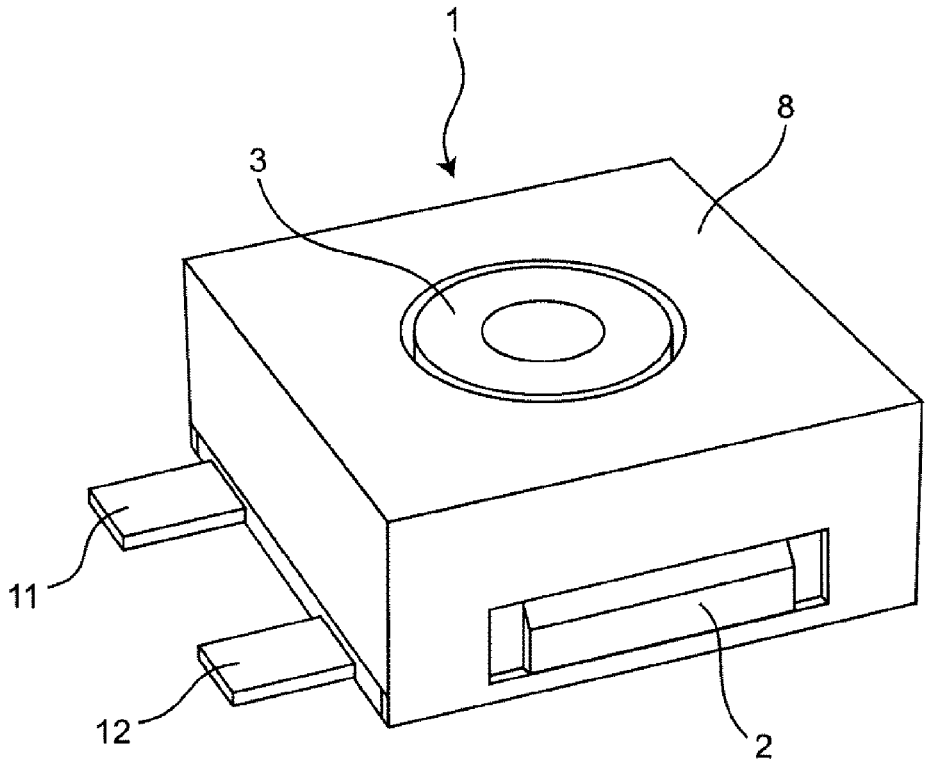
FIG. 1 is a perspective view illustrating a rotary variable resistor according to a first preferred embodiment of the present invention.
Figure 2A:
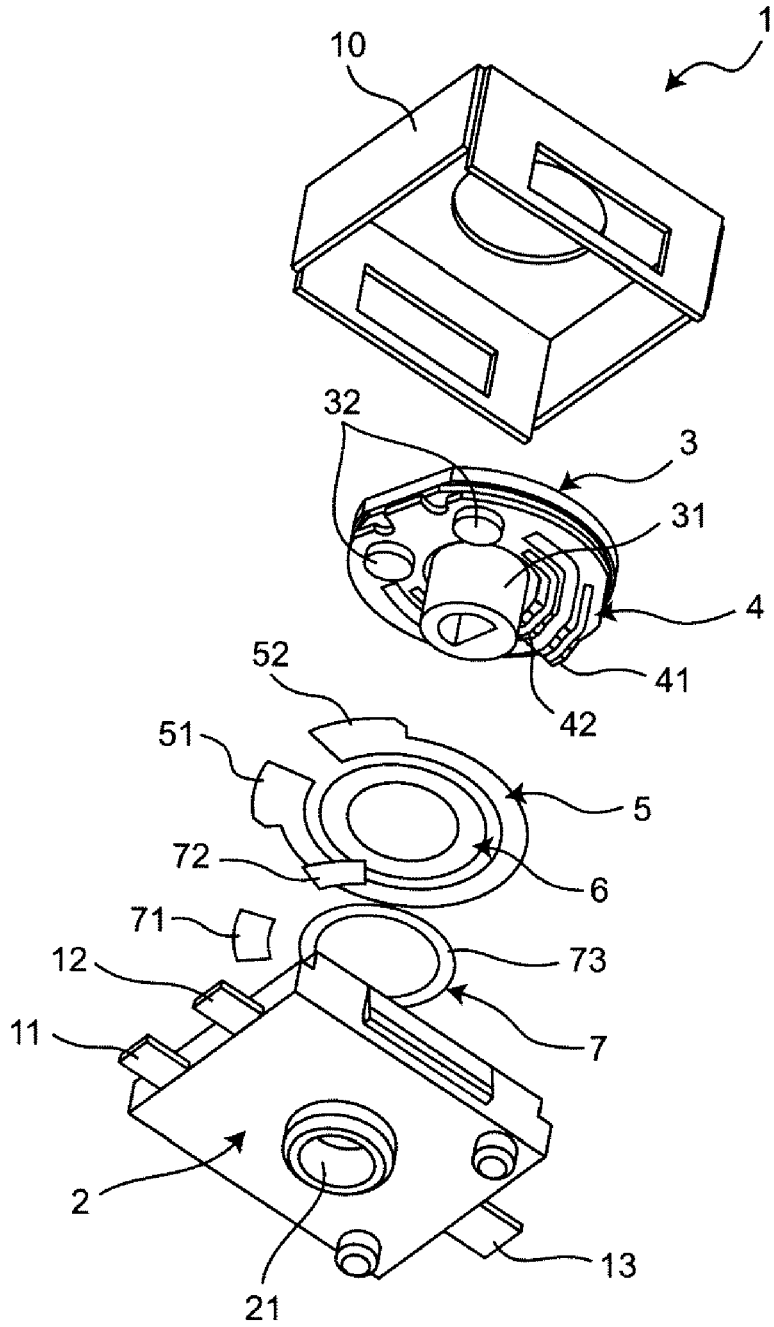
FIGS. 2A and 2B are exploded perspective views of the rotary variable resistor according to a preferred embodiment of the present invention when viewed from the lower side.
Figure 2B:
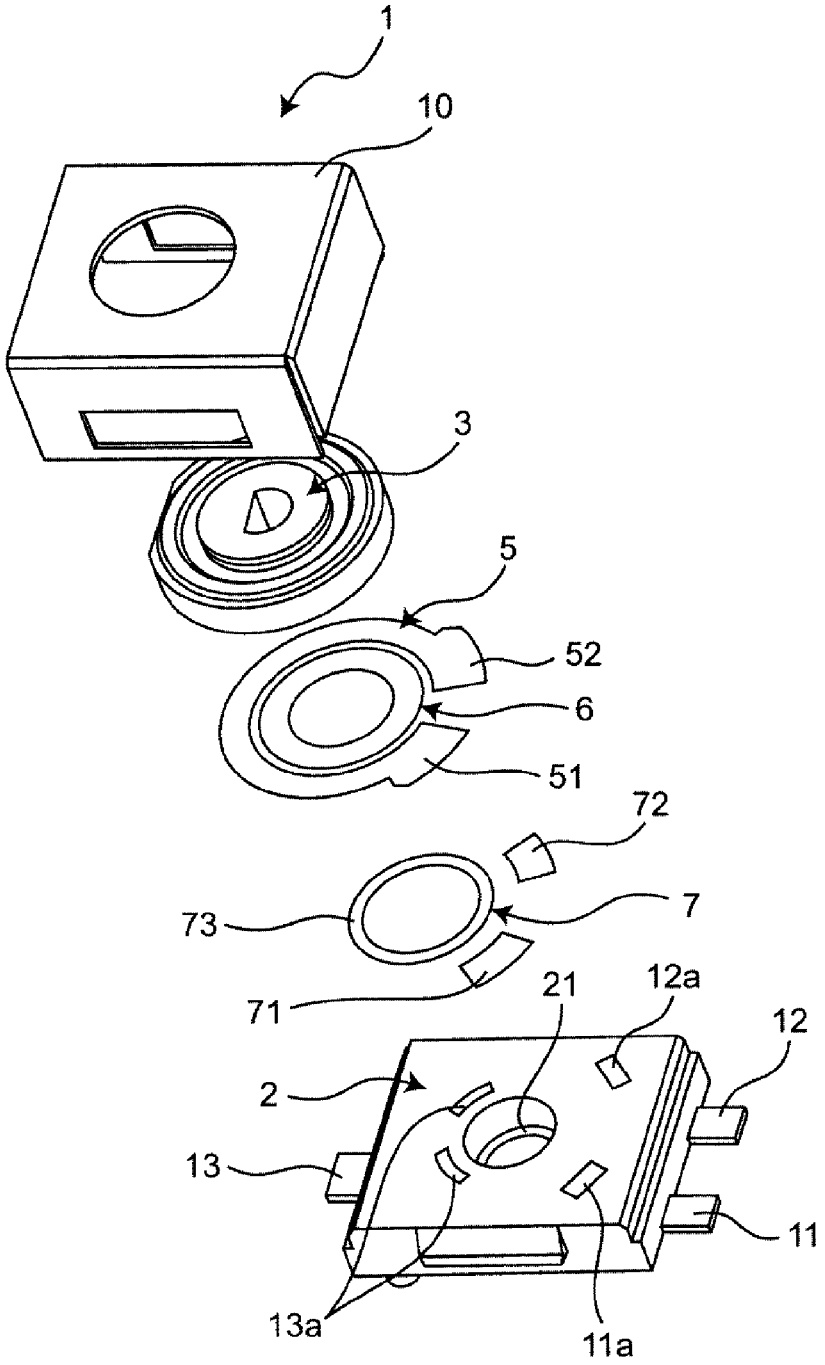

FIG. 1 is a perspective view illustrating a rotary variable resistor according to a preferred embodiment of the present invention. FIG. 2A is an exploded perspective view of the rotary variable resistor when viewed from the lower side. FIG. 2B is an exploded perspective view of the rotary variable resistor when viewed from the upper side.

As illustrated in FIG. 1, FIG. 2A, and FIG. 2B, a rotary variable resistor 1 includes an insulating substrate 2, a resistor pattern 5 and a current collector pattern 6 that are provided on the insulating substrate 2, a rotor 3 that is mounted on the insulating substrate 2 in a rotatable manner, and a slider 4 that is mounted on the rotor 3 so as to be rotatable together with the rotor 3.

First, second, and third terminals 11, 12, and 13 are provided in and on the insulating substrate 2. The first terminal 11 includes an exposed electrode 11*a* that is provided in the insulating substrate 2 and is exposed onto the insulating substrate 2. In the same manner, the second terminal 12 includes an exposed electrode 12*a* and the third terminal 13 includes exposed electrodes 13*a*.

An electrode pattern 7 is provided on the insulating substrate 2. The electrode pattern 7 is located between the resistor pattern 5 and the current collector pattern 6 and the exposed electrodes 11*a*, 12*a*, and 13*a*. The resistor pattern 5 and the current collector pattern 6 and the exposed electrodes 11*a*, 12*a*, and 13*a* are conducted to each other with the electrode pattern 7 interposed therebetween. When it is difficult to cause the resistor pattern 5 and the exposed electrodes 11*a*, 12*a*, and 13*a* to be directly conducted to each other, the resistor pattern 5 and the exposed electrodes 11*a*, 12*a*, and 13*a* are able to be indirectly conducted to each other by interposing the electrode pattern 7 therebetween in the above-described manner, thus ensuring high reliability.

A cap 10 is mounted on the insulating substrate 2 in a detachable manner. The cap 10 covers the rotor 3, the slider 4, the resistor pattern 5, the current collector pattern 6, and the electrode pattern 7.

Figure 3:
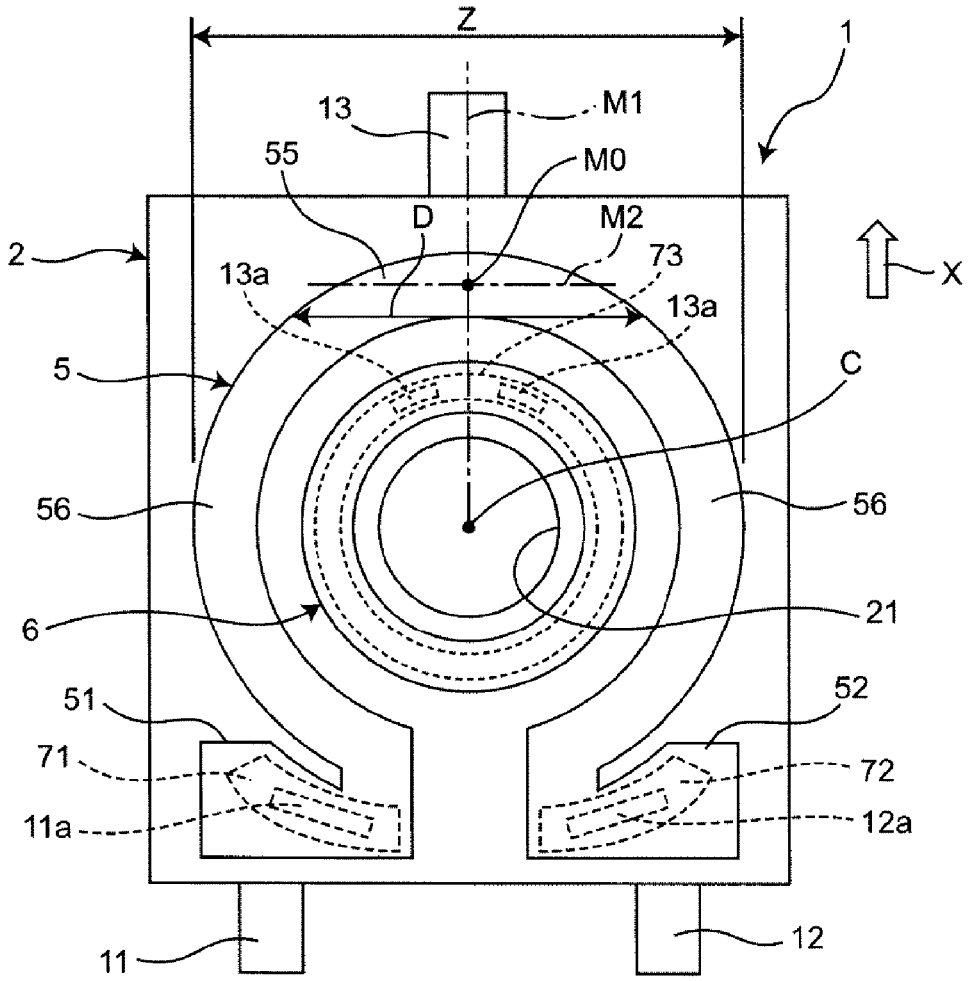
FIG. 3 is a plan view illustrating a state in which a cap, a rotor, and a slider of the rotary variable resistor according to a preferred embodiment of the present invention are removed.

FIG. 3 is a plan view illustrating a state in which the cap 10, the rotor 3, and the slider 4 of the rotary variable resistor 1 are removed. As illustrated in FIGS. 2A and 2B, and FIG. 3, the insulating substrate 2 preferably has a rectangular or substantially rectangular shape when seen from the above. A hole 21 is provided in the insulating substrate 2. A boss 31 of the rotor 3 is fitted into the hole 21 of the insulating substrate 2. The rotor 3 rotates about a rotating axis C. The insulating substrate 2 and the rotor 3 are made of, for example, resin.

The resistor pattern 5 and the current collector pattern 6 are separated from each other. The resistor pattern 5 preferably has a shape obtained by cutting out a portion of a ring shape about the rotating axis C. The resistor pattern 5 includes a first end portion 51 and a second end portion 52. The current collector pattern 6 preferably has a ring shape in which the rotating axis C is the center thereof. The current collector pattern 6 is located at the inner side of the resistor pattern 5. The resistor pattern 5 and the current collector pattern 6 are preferably made of the same material, and are made of, for example, a material formed by phenolic resin impregnated with carbon black.

The slider 4 is mounted and positioned on the boss 31 and two projections 32 of the rotor 3. The slider 4 preferably has a substantially ring shape. The slider 4 includes a first projection 41 and a second projection 42. The first projection 41 and the second projection 42 are conducted to each other. The slider 4 makes sliding contact with the resistor pattern 5 and the current collector pattern 6 to cause the resistor pattern 5 and the current collector pattern 6 to be conducted to each other. That is to say, the first projection 41 makes sliding contact with the resistor pattern 5 and the second projection 42 makes sliding contact with the current collector pattern 6 to cause the resistor pattern 5 and the current collector pattern 6 to be conducted to each other. The slider 4 is made of, for example, metal.

The electrode pattern 7 includes a first electrode portion 71, a second electrode portion 72, and a third electrode portion 73. The first electrode portion 71 makes contact with the first end portion 51 of the resistor pattern 5 in an overlapped manner. The second electrode portion 72 makes contact with the second end portion 52 of the resistor pattern 5 in an overlapped manner. The third electrode portion 73 preferably has a ring shape. The third electrode portion 73 makes contact with the current collector pattern 6 in an overlapped manner. The electrode pattern 7 is made of, for example, metal.

Portions of the first terminal 11 and the second terminal 12 are drawn from a first side of the insulating substrate 2. A portion of the third terminal 13 is drawn from a second side of the insulating substrate 2, which opposes the first side thereof. The exposed electrode 11*a* of the first terminal 11 makes contact with the first electrode portion 71 in an overlapped manner. The exposed electrode 12*a* of the second terminal 12 makes contact with the second electrode portion 72 in an overlapped manner. The exposed electrodes 13*a* of the third terminal 13 make contact with the third electrode portion 73 in an overlapped manner. The first, second, and third terminals 11, 12, and 13 are made of, for example, metal.

The first end portion 51 of the resistor pattern 5 and the exposed electrode 11*a* of the first terminal 11 are conducted to each other with the first electrode portion 71 interposed therebetween. The second end portion 52 of the resistor pattern 5 and the exposed electrode 12*a* of the second terminal 12 are conducted to each other with the second electrode portion 72 interposed therebetween. The current collector pattern 6 and the exposed electrodes 13*a* of the third terminal 13 are conducted to each other with the third electrode portion 73 interposed therebetween.

Figure 4:
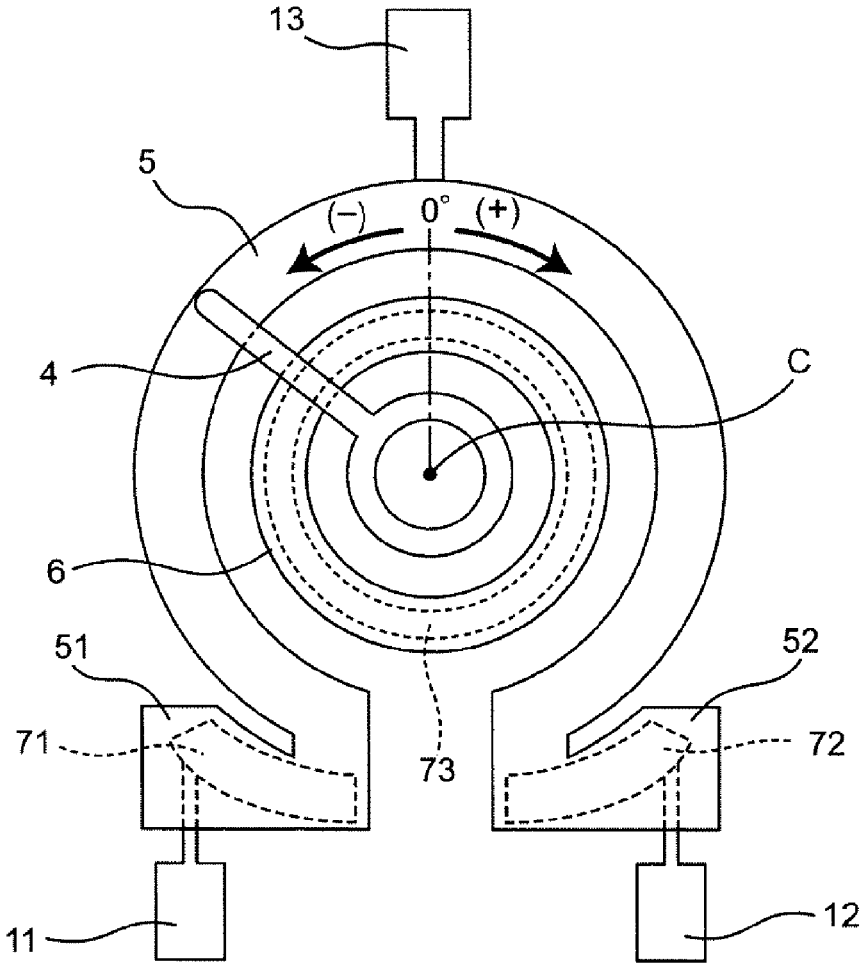
FIG. 4 is a descriptive view for explaining operations of a rotary variable resistor according to a preferred embodiment of the present invention.

FIG. 4 is a descriptive view for explaining operations of the rotary variable resistor 1. FIG. 4 illustrates the slider 4 with a simple shape. As illustrated in FIG. 4, a constant voltage $V_{cc}$ is applied to between the first terminal 11 and the second terminal 12. Rotation of the slider 4 causes a voltage $V_{13}$ between the first terminal 11 and the third terminal 13 to vary. That is to say, the voltage $V_{13}$ varies in accordance with a rotation angle of the slider 4. The rotation angle of the slider 4 (rotor 3) is easily detected by measuring the voltage $V_{13}$.

In FIG. 4, a center position of the resistor pattern 5 between the first end portion 51 and the second end portion 52 is assumed to have a center angle 0° about the rotating axis C. A rotation angle at the second end portion 52 side is a positive value whereas a rotation angle at the first end portion 51 side is a negative value with reference to the center angle 0°. In FIG. 4, the positive value is indicated by (+) whereas the negative value is indicated by (−).

Figure 5:
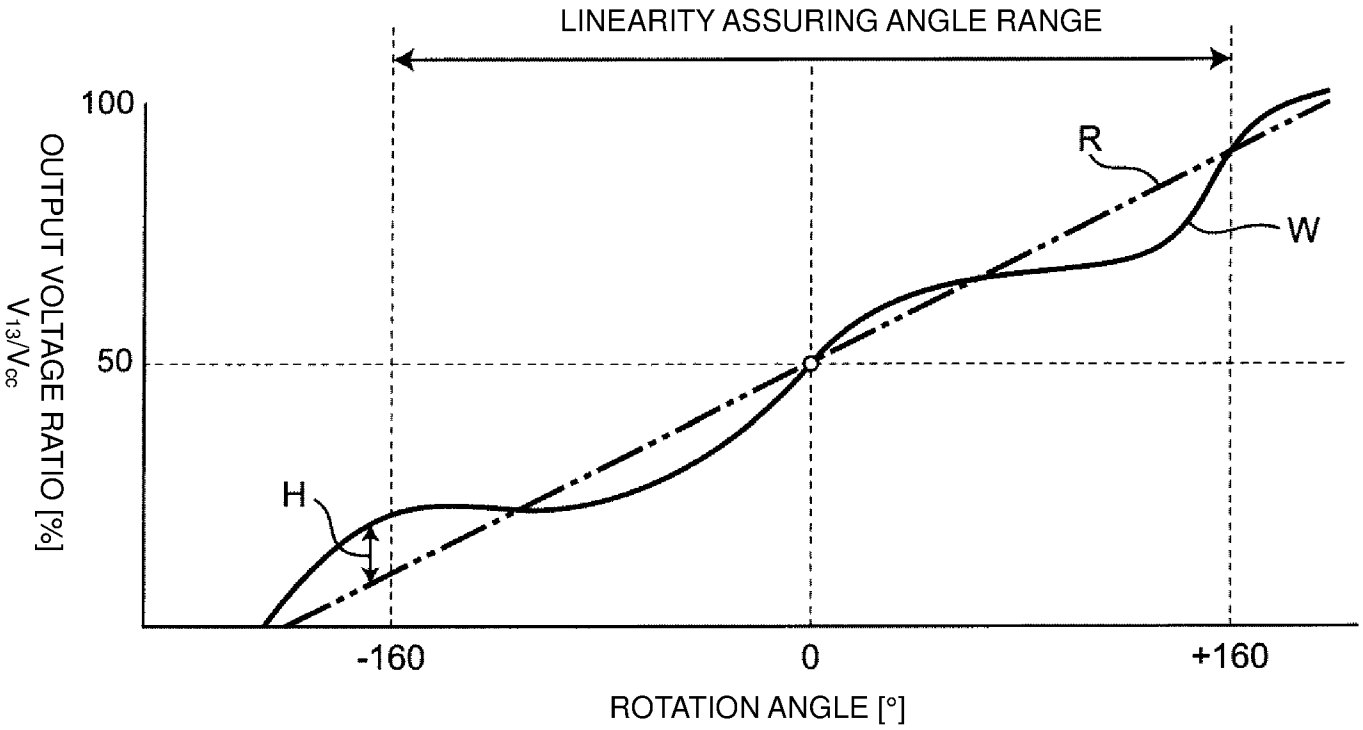
FIG. 5 is a graph illustrating a relationship between an output voltage ratio and a rotation angle in the invention.

FIG. 5 is a graph illustrating a relationship between an output voltage ratio and the rotation angle. The vertical axis indicates the output voltage ratio [%] and the horizontal axis indicates the rotation angle [°] of the slider 4 (rotor 3). The output voltage ratio is ($V_{13}/V_{cc}\times100$). As illustrated in FIG. 5, ideal values are indicated by an ideal straight line R (with a virtual line) and measured values are indicated by a measured curve W (with a solid line). The inclination of the ideal straight line R is, for example, 100[%]/333.3[°]. The ideal straight line R and the measured curve W overlap with each other at an intersection at which the rotation angle is 0° and the output voltage ratio is 50%, for example.

A maximum vertical deviation H of the measured curve W from the ideal straight line R is referred to as electric linearity L [%]. As a value of the electric linearity L is smaller, linearity is more preferable. To be specific, L is expressed by deviation amount/Vcc×100. The deviation amount indicates a voltage difference corresponding to the maximum vertical deviation H. In FIG. 5, a range of the rotation angle assuring the electric linearity L is a range of equal to or larger than −160° and equal to or smaller than +160°, for example.

As illustrated in FIG. 3, a maximum dimension of the resistor pattern 5, which is effective as a variable resistor, is Z [mm]. The maximum dimension Z is a maximum dimension of the outer shape of the resistor pattern 5. A portion of the resistor pattern 5, which is effective as a variable resistor, is a portion of the resistor pattern 5, which defines and functions as a resistor, and is a portion of the resistor pattern 5, which does not overlap with the electrode patterns 71 and 72. The maximum dimension Z of the resistor pattern 5 is, for example, a diameter when the outer shape of the resistor pattern 5 is a circular shape or a long side when the outer shape of the resistor pattern 5 is a rectangular shape.

$Z\leq4.0$ and $Z\times L<10$ are satisfied with respect to a relationship between the maximum dimension Z [mm] and the electric linearity L[%]. The rotary variable resistor 1 is able to be reduced in size because $Z\leq4.0$ is satisfied. Furthermore, the electric linearity is able to be improved because $Z\times L<10$ is satisfied. Accordingly, the rotary variable resistor 1 achieves both a reduction in size and an increase in accuracy. By contrast, when $Z>4.0$ is satisfied, the rotary variable resistor 1 is increased in size, and when $Z\times L\geq10$ is satisfied, the electric linearity is deteriorated.

As illustrated in FIG. 3, the resistor pattern 5 and the current collector pattern 6 are configured preferably by applying paste onto the insulating substrate 2 in a first direction X by screen printing. The first direction X indicates a printing direction and a direction in which the paste is transported on a screen film by a squeegee, as will be described later.

Normally, the film thickness of a portion of the resistor pattern 5, which has the maximum length in the direction perpendicular or substantially perpendicular to the first direction X, is easy to vary. Therefore, the inventors of the present application have focused on this point and have discovered that variations in the film thickness of the overall resistor pattern 5 is decreased or eliminated by making the variation in the film thickness of the above-described portion be in a predetermined range.

As is described in detail, the resistor pattern 5 includes a portion (hereinafter, referred to as a top portion 55) at the downstream side in the first direction X and portions (hereinafter, referred to as side portions 56) at the center side in the first direction X. The top portion 55 is located at the side of the portion of the resistor pattern 5, which has the maximum length in the direction perpendicular or substantially perpendicular to the first direction X. As will be described later, the screen film has a hole corresponding to the resistor pattern 5. The size of an opening of the hole, which corresponds to the top portion 55, is larger than the size of openings of the hole, which correspond to the side portions 56. Therefore, in the existing technique, a difference in a pushing amount by the squeegee has been generated between the portion of the hole, which corresponds to the top portion 55, and the portions of the hole, which correspond to the side portions 56. In particular, the portion of the hole of the screen film, which corresponds to the top portion 55, is largely pushed to cause the variation in the film thickness of the top portion 55 to be increased. Therefore, the inventors of the present application have focused on the film thickness of the top portion 55 and have discovered that the variation in the film thickness of the overall resistor pattern 5 is decreased by making the variation in the film thickness of the top portion 55 be in a predetermined range.

Figure 6:
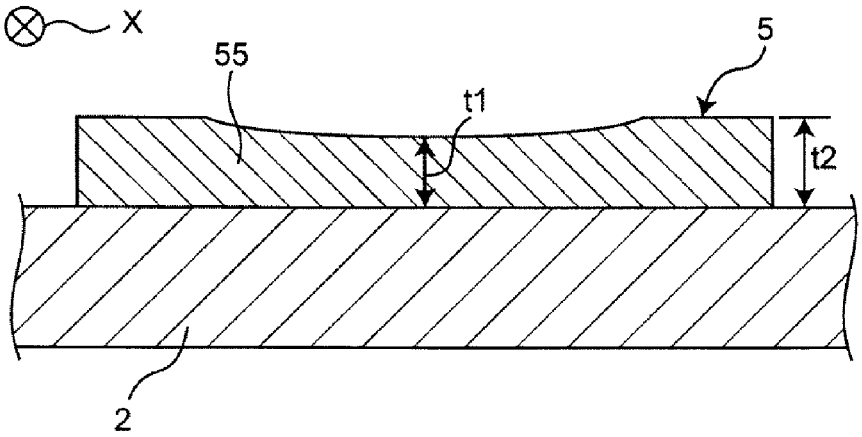
FIG. 6 is a cross-sectional view of a top portion of the rotary variable resistor along a plane perpendicular or substantially perpendicular to a first direction according to a preferred embodiment of the present invention.

In summary, a straight line in parallel or substantially in parallel with the first direction X and passing through the rotating axis C when viewed in the direction along the rotating axis C is a first straight line M1. A point located at the center of the width (width of the top portion 55) of the resistor pattern 5 at the side of the portion having the maximum length in the direction perpendicular or substantially perpendicular to the first direction X on the first straight line M1 is a middle point M0. The maximum length of the resistor pattern 5 in the direction perpendicular or substantially perpendicular to the first direction X is a length D at an intersection between the first straight line M1 and the inner circumference of the resistor pattern 5 at a position perpendicular or substantially perpendicular to the first straight line M1. A straight line passing through the middle point M0 and perpendicular or substantially perpendicular to the first straight line M1 is a second straight line M2. As illustrated in FIG. 6, when on a cross section of the resistor pattern 5 along the second straight line M2, a film thickness of a center portion in the direction along the second straight line M2 is t1 and a maximum film thickness is t2, $1.0 \leq (t2/t1) < 1.2$ is satisfied. The upper surface of the resistor pattern 5 is a recessed surface. Therefore, the maximum film thickness t2 is a film thickness of end portions of the resistor pattern 5 in the direction along the second straight line M2. It should be noted that the same holds true for the side portions 56 of the resistor pattern 5.

The variation in the film thickness of the resistor pattern 5 is able to be decreased to improve the electric linearity because $1.0 \leq (t2/t1) < 1.2$ is satisfied. Accordingly, the rotary variable resistor 1 reduced in size achieves an increase in accuracy. By contrast, when $1.2 \leq (t2/t1)$ is satisfied, the electric linearity is deteriorated.

Furthermore, the resistor pattern 5 is configured preferably by applying the paste onto insulating substrate 2 by the screen printing, which is the cheapest and effective, thus achieving reduction in cost. Moreover, the resistor pattern 5 and the current collector pattern 6 are preferably made of the same material, thus achieving reduction in cost.

Next, a non-limiting example of a method for manufacturing the rotary variable resistor 1 is described.

Figure 7A:
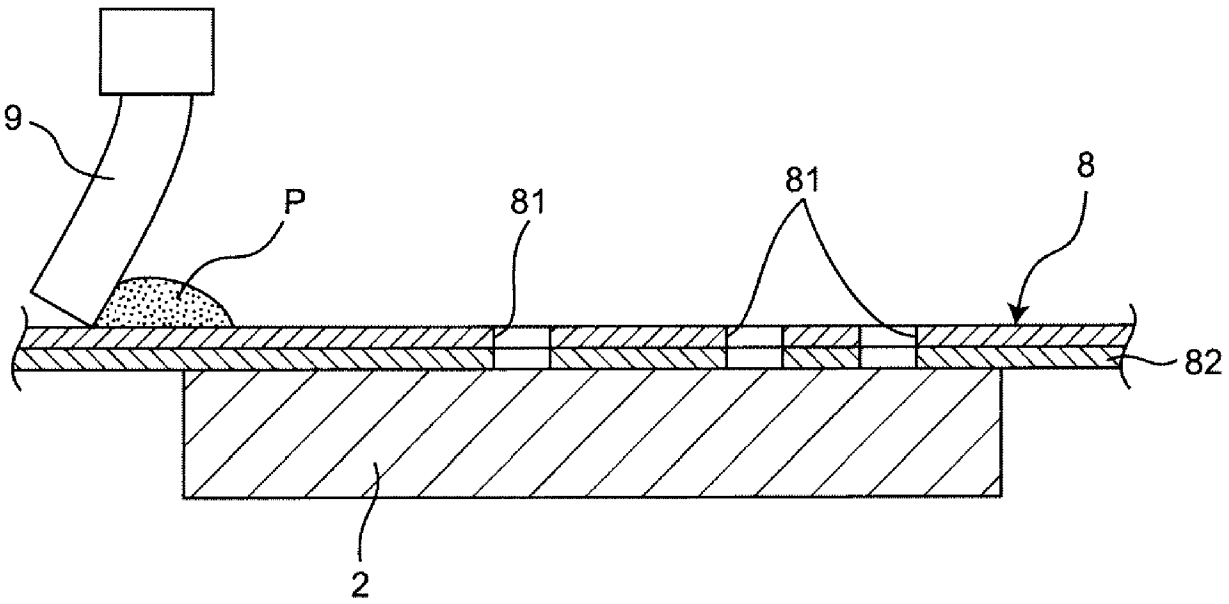
FIGS. 7A-7C are descriptive views for explaining a method for manufacturing a rotary variable resistor according to a preferred embodiment of the present invention.

First, as illustrated in FIG. 7A, a screen film 8 is formed on the insulating substrate 2 so as to be separated therefrom. This processing is called a screen film arrangement process. The screen film 8 includes holes 81 corresponding to the resistor pattern 5 and the current collector pattern 6. An emulsion 82 is mounted on the screen film 8 and the emulsion 82 keeps an interval between the screen film 8 and the insulating substrate 2 to be constant. The emulsion 82 is made of, for example, resin. The emulsion 82 is formed around the holes 81.

Thereafter, pastes P are placed on the screen film 8. This processing is called a paste placement process. The pastes P are a material of the resistor pattern 5 and the current collector pattern 6.

Figure 7B:
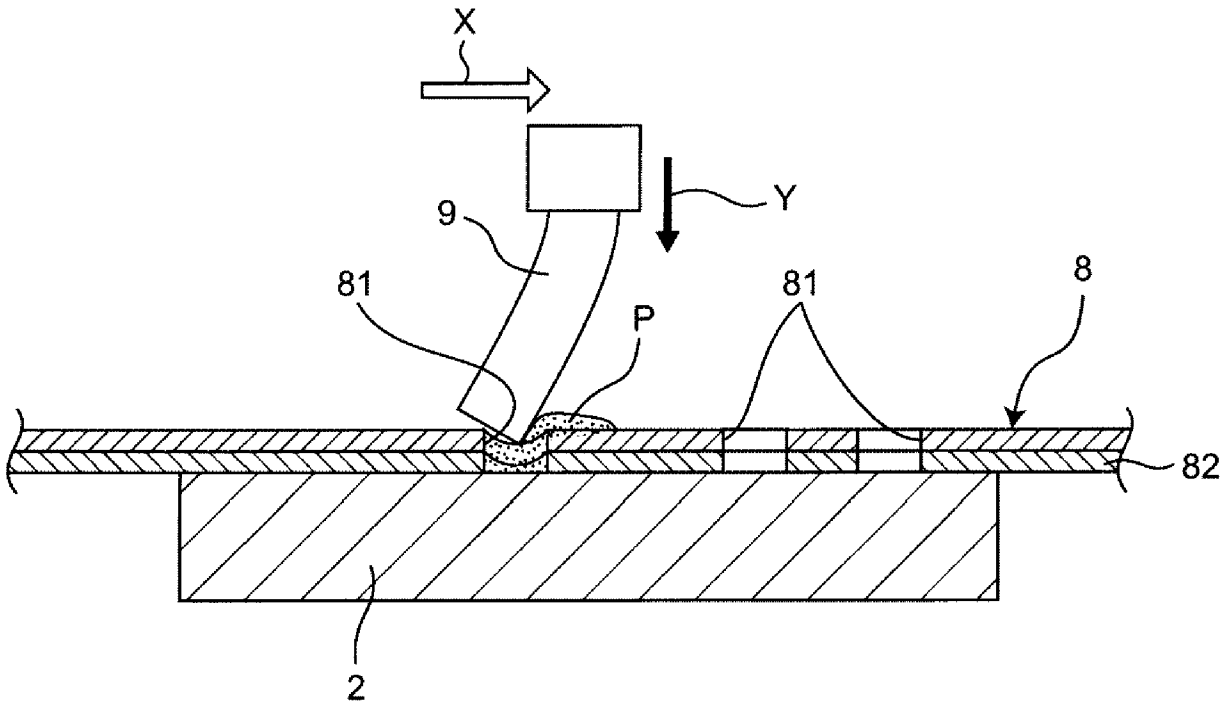
Figure 7C:
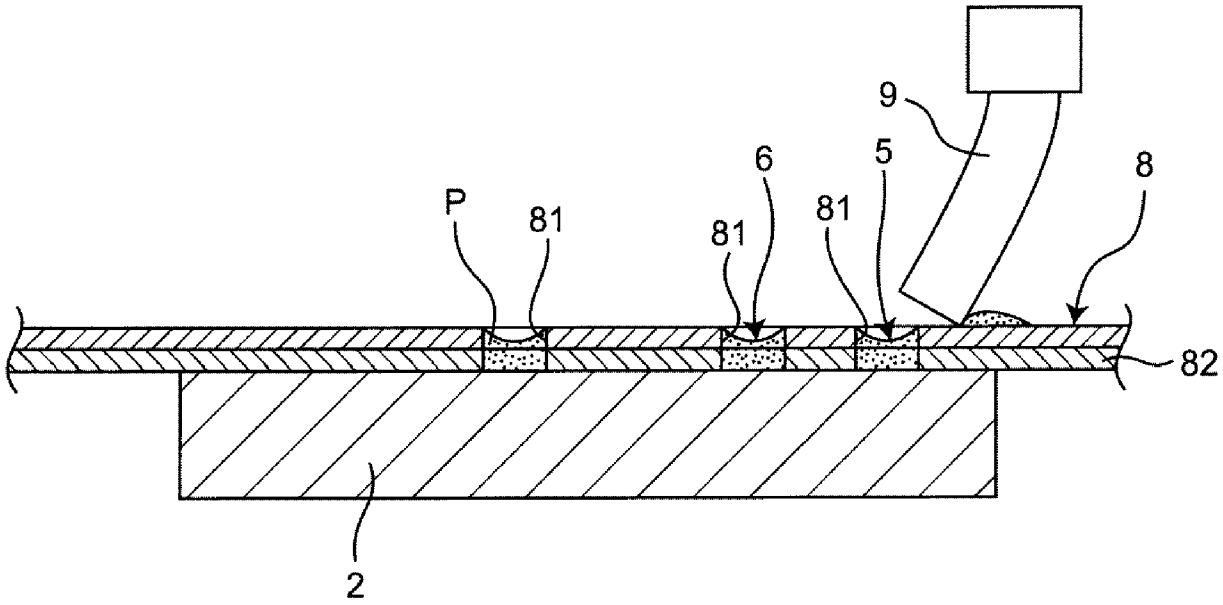

After that, as illustrated in FIG. 7B, the pastes P are transported on the screen film 8 in the first direction X while pressing the screen film 8 to the insulating substrate 2 side (in a second direction Y) by a squeegee 9 and are pushed out from the holes 81 of the screen film 8. Then, as illustrated in FIG. 7C, the resistor pattern 5 and the current collector pattern 6 are formed on the insulating substrate 2 with the pastes P that have remained after they have been pushed out from the holes 81. This processing is called a pattern formation process. Thereafter, the pastes P are solidified by heating to manufacture the rotary variable resistor 1.

Figure 8A:
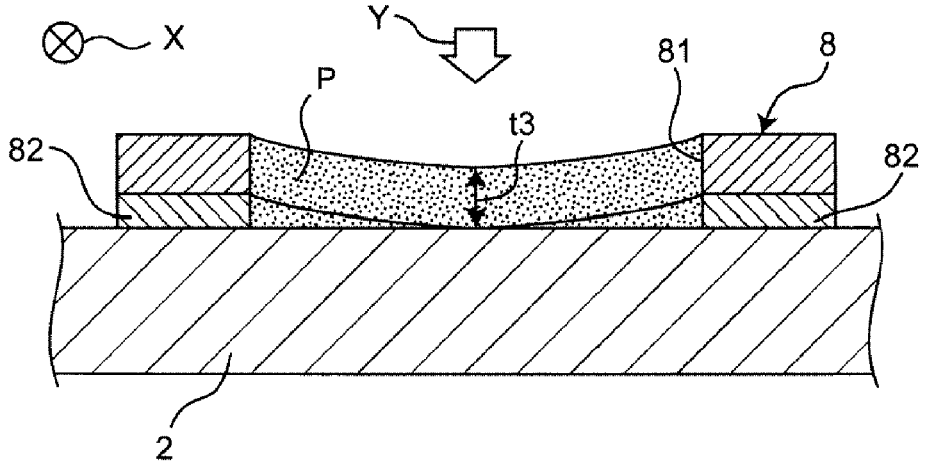
FIGS. 8A and 8B are descriptive views for explaining a method for manufacturing a top portion of a resistor pattern according to a preferred embodiment of the present invention.
Figure 8B:
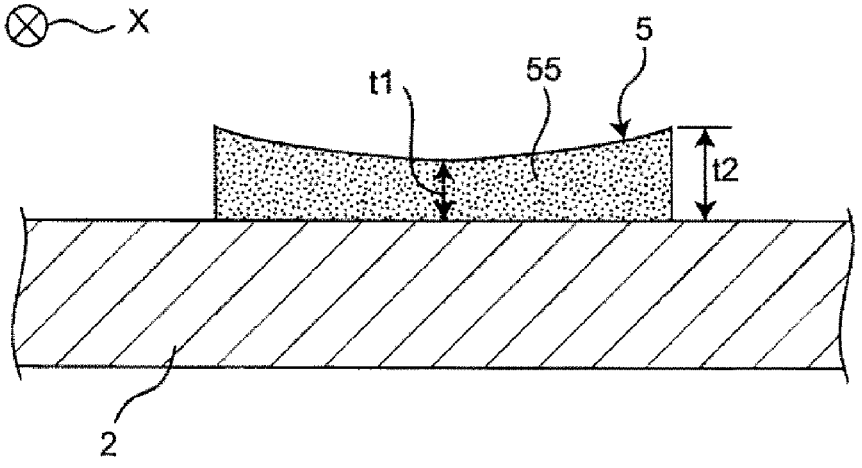

In the pattern formation process, the resistor pattern 5 is formed on the insulating substrate 2 as illustrated in FIG. 8B while pressing the screen film 8 in the second direction Y by the squeegee 9 so as to make the screen film 8 contact with the insulating substrate 2 as illustrated in FIG. 8A. Although the top portion 55 of the resistor pattern 5 is described with reference to FIG. 8A and FIG. 8B, the current collector pattern 6 is also preferably formed in the same manner. The substantially constant film thicknesses t1 and t2 can be obtained in the top portion 55 by sufficiently pushing the screen film 8 in the above-described manner to apply the paste with a thickness t3 of the screen film 8 regardless of the sizes of the openings of the holes 81 of the screen film 8. Normally, the screen film 8 is not made to contact with the insulating substrate 2 in the screen printing. However, the inventors of the present application have discovered that the variations in the film thickness are significantly reduced or prevented by making the screen film 8 contact with the insulating substrate 2.

Figure 9A:
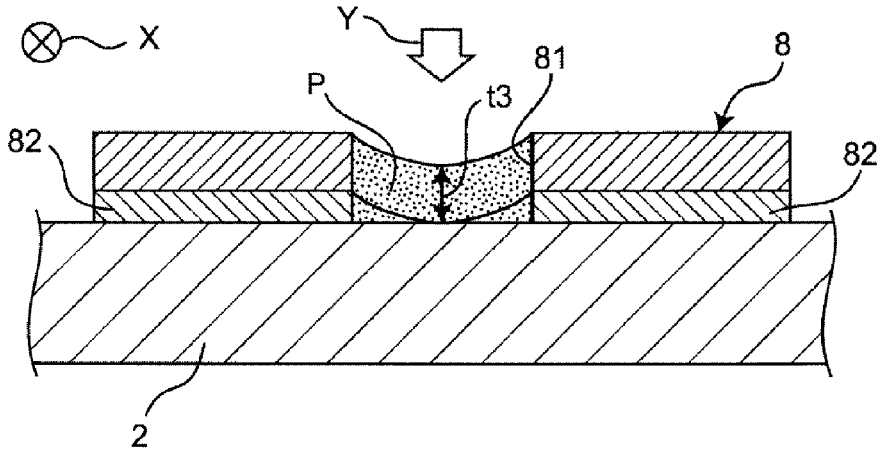
FIGS. 9A and 9B are descriptive views for explaining a method for manufacturing side portions of the resistor pattern according to a preferred embodiment of the present invention.
Figure 9B:
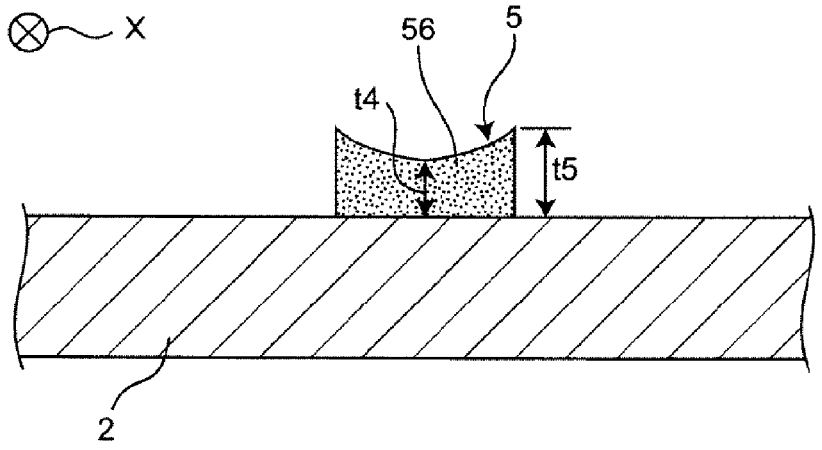

The same holds true for the side portions 56 of the resistor pattern 5. That is to say, the resistor pattern 5 is formed on the insulating substrate 2 as illustrated in FIG. 9B while pressing the screen film 8 in the second direction Y by the squeegee 9 so as to make the screen film 8 contact with the insulating substrate 2 as illustrated in FIG. 9A. Constant or substantially constant film thicknesses t4 and t5 are able to be obtained in the side portions 56 by sufficiently pushing the screen film 8 in the above-described manner to apply the paste with the thickness t3 of the screen film 8. The film thickness t4 of the center portions of the side portions 56 is the same or substantially the same as the film thickness t1 of the center portion of the top portion 55 and the film thickness t5 of the end portions of the side portions 56 is the same or substantially the same as the film thickness t2 of the end portions of the top portion 55.

Accordingly, the thicknesses of the resistor pattern 5 and the current collector pattern 6 are able to be controlled with the thicknesses of the holes 81 of the screen film 8 because the resistor pattern 5 and the current collector pattern 6 are printed while sufficiently pushing the screen film 8 by the squeegee 9. Therefore, the thicknesses of the resistor pattern 5 and the current collector pattern 6 are able to be made substantially constant regardless of the sizes of the openings of the holes 81 of the screen film 8. This enables the variation in the film thickness of the resistor pattern 5 to be decreased to improve the electric linearity. Accordingly, when the rotary variable resistor 1 reduced in size is manufactured, increase in accuracy is achieved.

Thus, a preferred embodiment of the present invention can perform printing with the constant or substantially constant thicknesses particularly significantly when the sizes of the openings of the holes 81 of the screen film 8 vary in the printing direction (first direction X).

Furthermore, the emulsion 82 originally has a role of controlling the paste amount and has a role of interfering with roughness or swelling of the insulating substrate 2 according to a preferred embodiment of the present invention. Therefore, the thickness of the emulsion 82 is able to be reduced to the thickness necessary for interference with the roughness and the like. The screen film 8 having a rough count can be used in order to facilitate extension.

The electric linearity of the resistor pattern 5 is determined based on many factors but the variation in the film thickness of the resistor pattern 5 is dominant. A resistance value of the resistor pattern 5 is inversely proportionate to the cross-sectional area of the film thickness ($R=\rho \times L/S$ ($\rho$ is specific resistance, L is length, and S is cross-sectional area)) and it is important to reduce the variation in the cross-sectional area as small as possible.

Figure 10A:
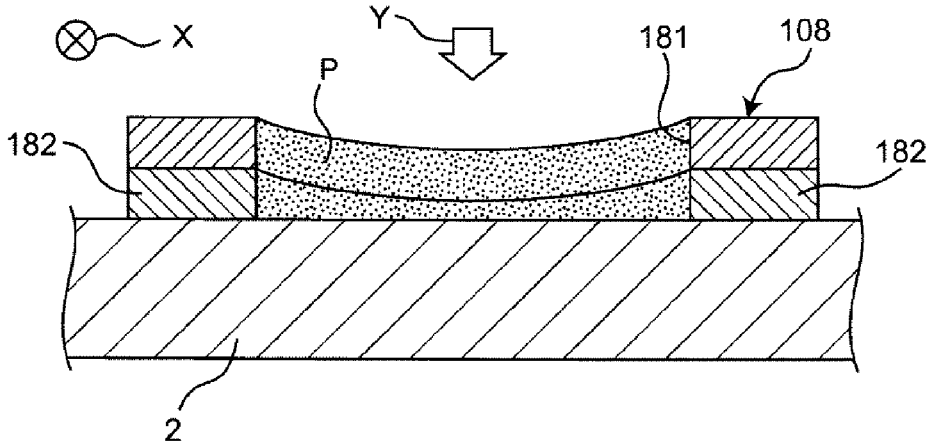
FIGS. 10A and 10B are descriptive views for explaining a method for manufacturing a top portion of a resistor pattern according to an existing technique.
Figure 10B:
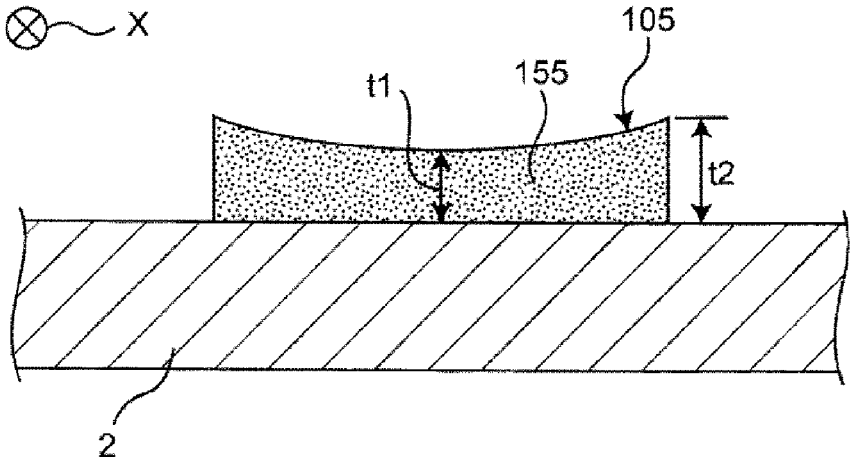

In an existing printing method, as illustrated in FIG. 10A and FIG. 10B, in a top portion 155 of a resistor pattern 105, the pushing amount by a squeegee is increased because an opening of a hole 181 of a screen film 108 is large as illustrated in FIG. 10A. As a result, as illustrated in FIG. 10B, the difference between the film thickness t1 of the center portion and the film thickness t2 of the end portions is increased.

Figure 11A:
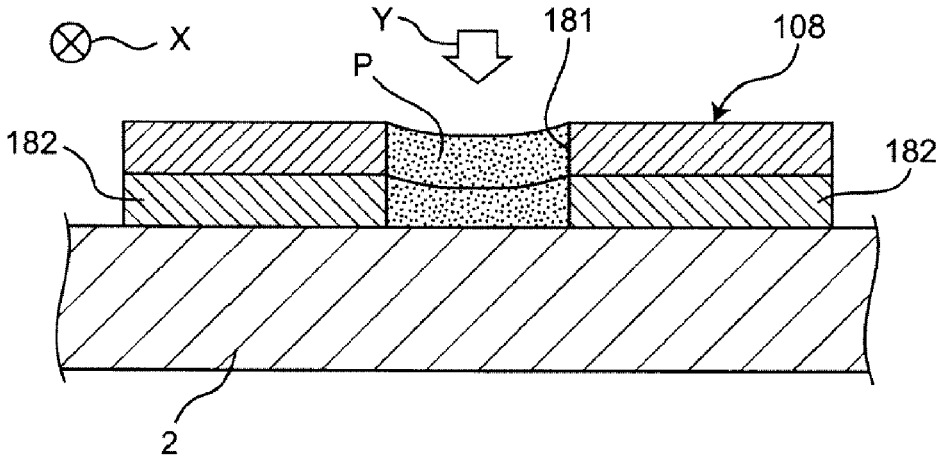
FIGS. 11A and 11B are descriptive views for explaining a method for manufacturing side portions of the resistor pattern according to the existing technique.
Figure 11B:
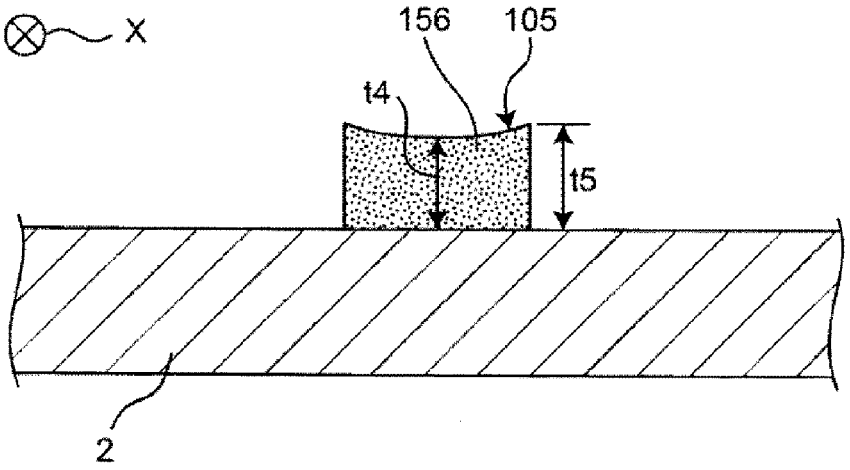

On the other hand, as illustrated in FIG. 11A and FIG. 11B, in side portions 156 of the resistor pattern 105, the pushing amount by the squeegee is decreased because openings of the holes 181 of the screen film 108 are small as illustrated in FIG. 11A. As a result, as illustrated in FIG. 11B, the difference between the film thickness t4 of the center portions and the film thickness t5 of the end portions is decreased. However, the difference between the film thickness t1 of the center portion of the top portion 155 and the film thickness t4 of the center portions of the side portions 156 is increased as illustrated in FIG. 10B and FIG. 11B.

Accordingly, the variation in the film thickness of the resistor pattern 105 is generated, resulting in deterioration of the electric linearity. In this manner, with the existing method, the amount of the pastes P is controlled by not the thicknesses of the holes 181 of the screen film 108 but the thickness of an emulsion 182.

Next, examples of preferred embodiments of the present invention and the existing technique will be described for the film thickness of the top portion of the resistor pattern.

Figure 12A:
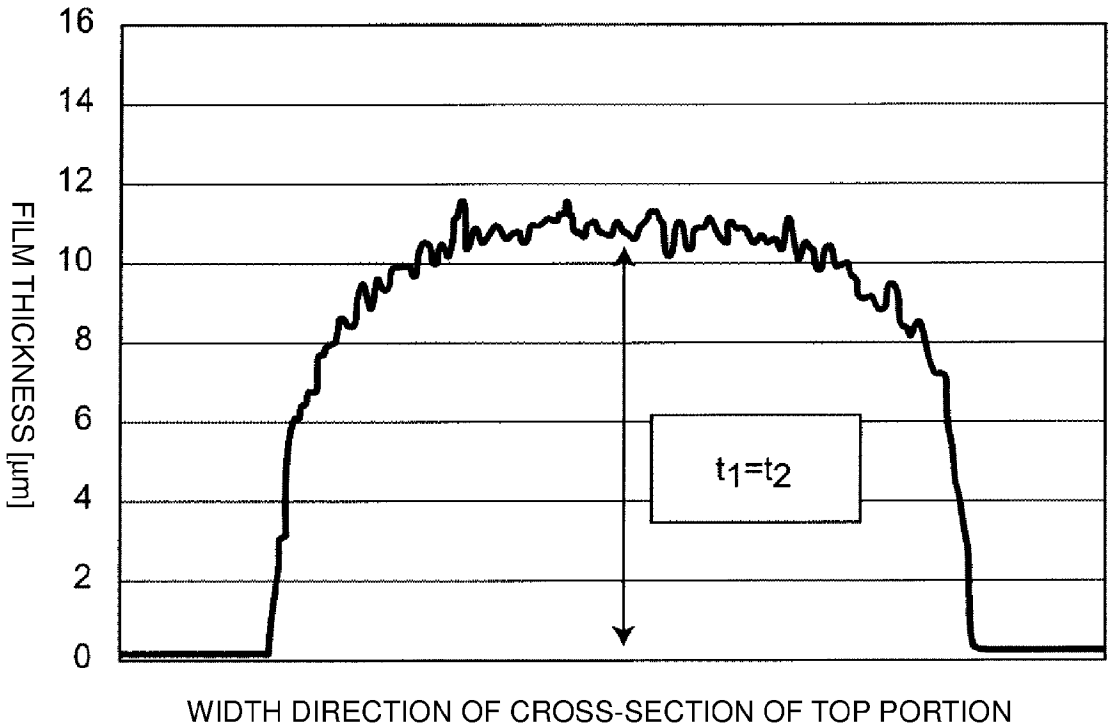
FIGS. 12A and 12B are graphs illustrating a film thickness of the top portion of the resistor pattern according to a preferred embodiment of the present invention.
Figure 12B:
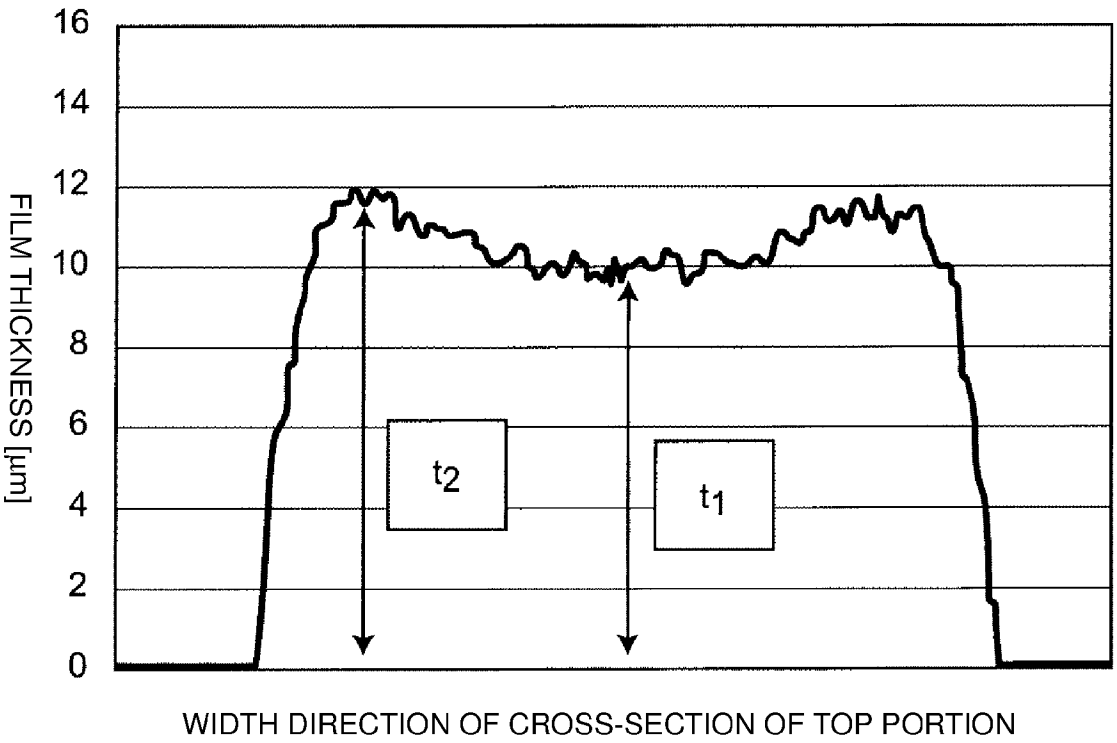

As illustrated in FIG. 12A, in the invention, the film thickness t1 of the center portion and the maximum film thickness t2 are equal or substantially equal to each other. On the other hand, as illustrated in FIG. 12B, in the existing technique, the difference between the film thickness t1 of the center portion and the maximum film thickness t2 is large and approximately 2 μm. In FIG. 12A and FIG. 12B, the horizontal axis indicates the width direction (direction along the second straight line M2 illustrated in FIG. 3) of the cross-section of the top portion and the vertical axis indicates the film thickness [μm].

Then, examples of preferred embodiments of the present invention and the existing technique will be described for the film thickness of the resistor pattern in the radial direction.

Figure 13:
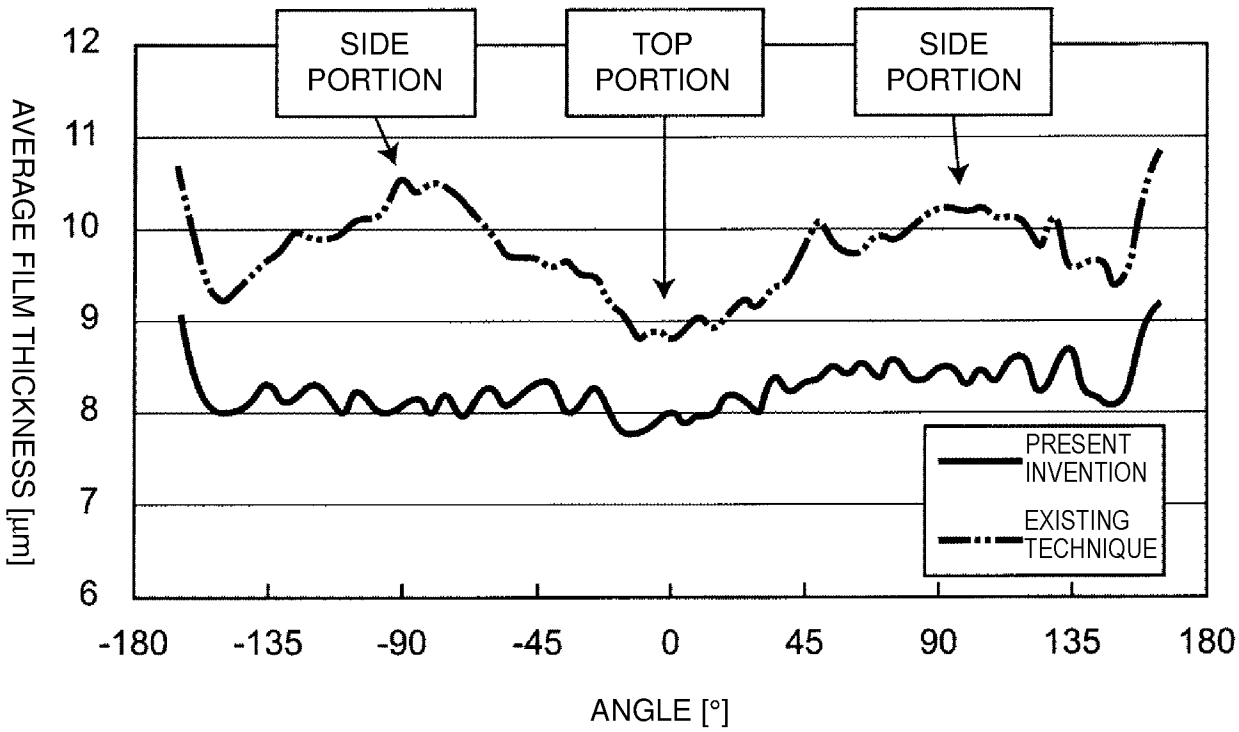
FIG. 13 is a graph illustrating film thicknesses of the resistor patterns in the radial direction in a preferred embodiment of the present invention and the existing technique.

In FIG. 13, the horizontal axis indicates an angle [°] and the vertical axis indicates an average film thickness [μm]. The angle is identical to the rotation angle described with reference to FIG. 4. The average film thickness is an average value of the film thicknesses of the resistor pattern in the radial direction.

As illustrated in FIG. 13, in a preferred embodiment of the present invention, the variation in the film thickness of the resistor pattern in the radial direction is small regardless of the angles as indicated by a solid line. On the other hand, in the existing technique, the variation in the film thickness of the resistor pattern in the radial direction is increased depending on the angles as indicated by a virtual line. That is to say, the difference between the film thickness of the top portion and the film thickness of the side portions is increased.

Next, an example of the rotary variable resistor 1 will be described.

The insulating substrate is made of PPS resin (DIC: FZ-3600). The first to third terminals are made of brass and plating processing of Ni and Ag is performed thereon. The first to third terminals are insert-molded into the insulating substrate.

The maximum dimension Z of the resistor pattern is ϕ3.58 mm, for example. The resistor pattern and the current collector pattern are made of a material formed by phenolic resin impregnated with carbon black and are formed on the insulating substrate by applying the paste thereto by screen printing. The electrode pattern is made of an Ag paste and is formed on the insulating substrate by applying the paste thereto by screen printing.

The rotor is made of LCP resin (polyplastics: LAPEROS E130G). The slider is made of albata and plating processing of Ni and Ag is performed thereon. The slider is insert-molded into the rotor. The cap is made of SUS304.

Second Preferred Embodiment

Figure 14:
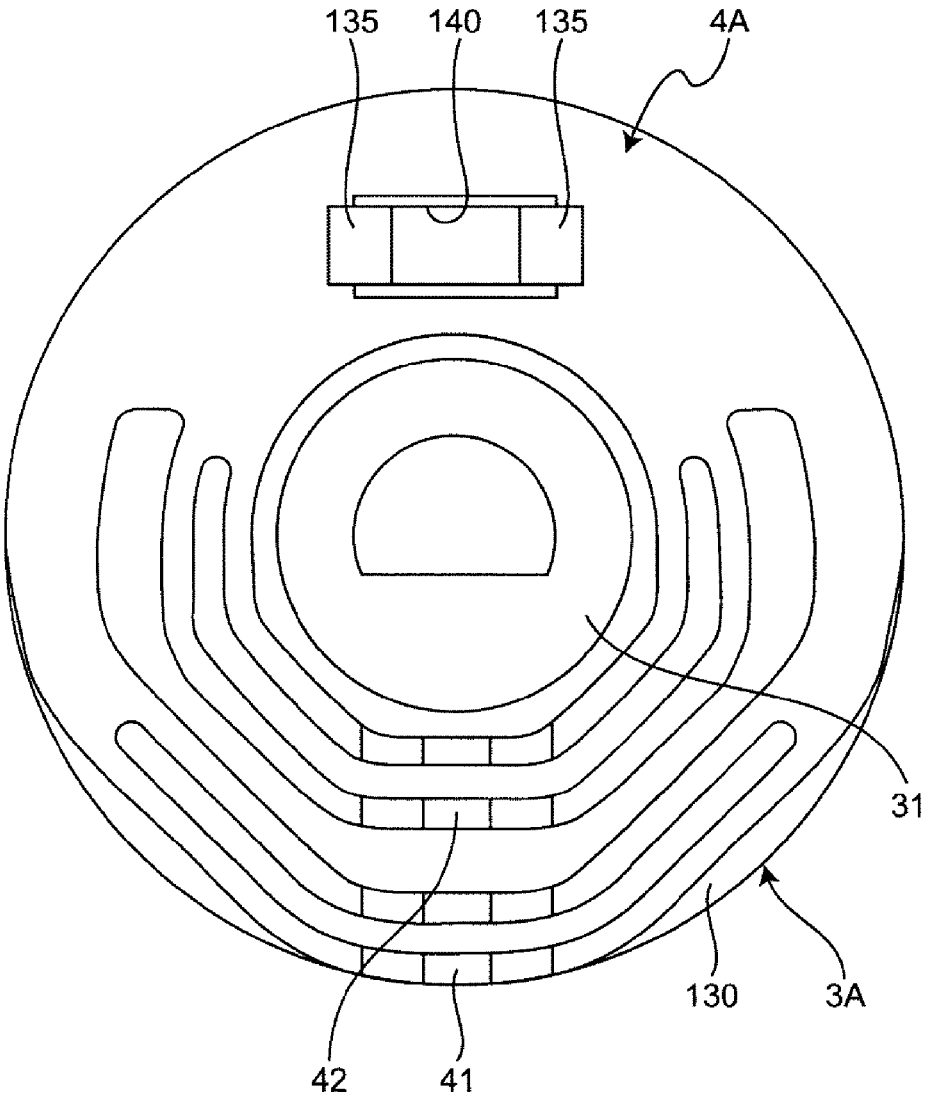
FIG. 14 is a plan view illustrating a rotor and a slider when viewed from the lower side according to a second preferred embodiment of the present invention.

FIG. 14 is a plan view illustrating a rotor and a slider when viewed from the lower side according to a second preferred embodiment of the present invention. As illustrated in FIG. 14, a rotor 3A includes a main body 130 made of resin and metal members 135 fixed to the main body 130. A slider 4A is locked by the metal members 135 and is mounted on the rotor 3A. The slider 4A is locked by the metal members 135 by bending and fixing of the metal members 135. The metal members 135 are fixed to the main body 130 by insert molding.

As is described specifically, the main body 130 includes a boss 31. The outer shape of the main body 130 has the same or substantially the same size as that of the outer shape of the slider 4A when seen from the above. The metal members 135 are defined by band-shaped metal plates. The two metal members 135 are fixed to the main body 130 by the insert molding. One end portions of the metal members 135 are embedded in the main body 130 and the other end portions of the metal members 135 are exposed from the main body 130. The other end portions of the metal members 135 are inserted into a hole 140 of the slider 4A to be bent and fixed. The slider 4A is locked by the metal members 135 by bending and fixing of the other end portions of the metal members 135.

Figure 15A:
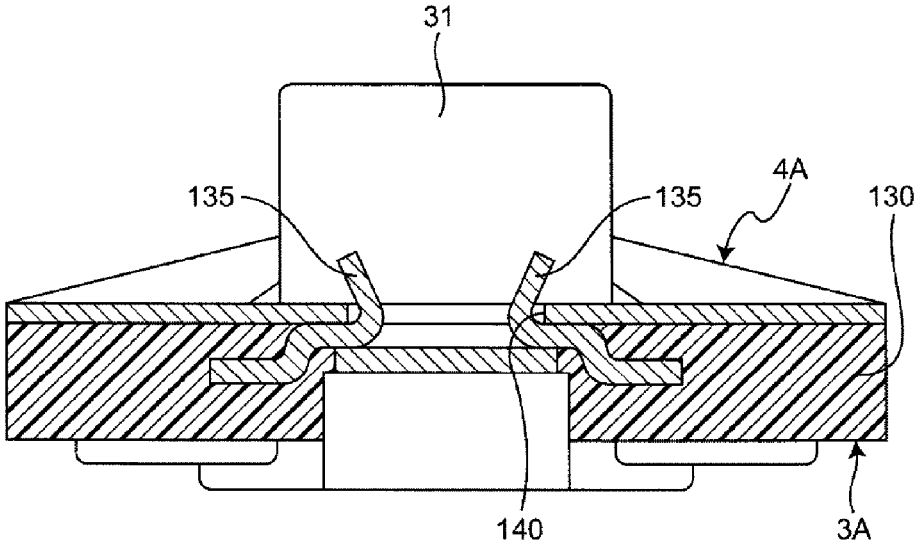
FIGS. 15A and 15B are descriptive views for explaining a method for fixing the slider to the rotor.
Figure 15B:
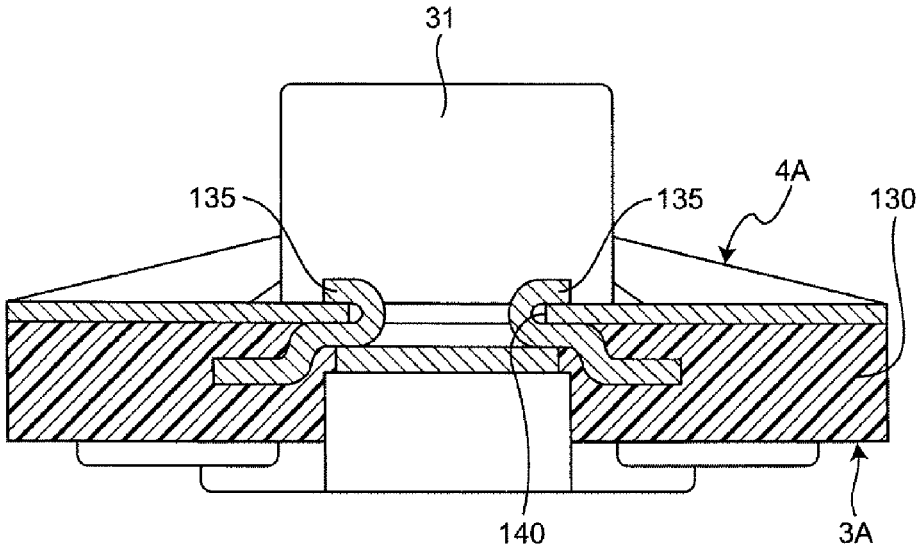

Next, a method for fixing the slider 4A to the rotor 3A is described. As illustrated in FIG. 15A, the slider 4A is installed on the main body 130 of the rotor 3A. In this case, the other end portions of the metal members 135 of the rotor 3A are inserted into the hole 140 of the slider 4A and the other end portions of the metal members 135 are slightly bent to temporarily fix the slider 4A to the metal members 135. Thereafter, as illustrated in FIG. 15B, the other end portions of the metal members 135 are bent to fix the slider 4A to the metal members 135.

With the second preferred embodiment, the slider 4A is locked by the metal members 135 fixed to the main body 130 and is mounted on the rotor 3A, thus decreasing generation of rattling between the slider 4A and the rotor 3A due to reflow soldering heat. With this, contact pressures of the slider 4A onto the resistor pattern and the current collector pattern do not fluctuate, thus providing stable contact between the resistor pattern and the current collector pattern and the slider 4A. Furthermore, weather resistance is significantly improved.

On the other hand, when the slider is inserted into a projection of the main body of the rotor and the projection made of resin is welded to integrate the slider and the rotor with each other, there is a risk that the projection is molten by reflow soldering heat. In this case, looseness between the slider and the rotor occurs and the slider rattles. Due to this, the contact pressures of the slider onto the resistor pattern and the current collector pattern fluctuate and stable contact between the resistor pattern and the current collector pattern and the slider cannot be obtained.

With the above-described second preferred embodiment, the slider 4A is locked by the metal members 135 by bending and fixing of the metal members 135, thus easily mounting the slider 4A on the rotor 3A.

Furthermore, the metal members 135 are fixed to the main body 130 by the insert molding, thus easily fixing the metal members 135 to the main body 130.

Third Preferred Embodiment

Figure 16:
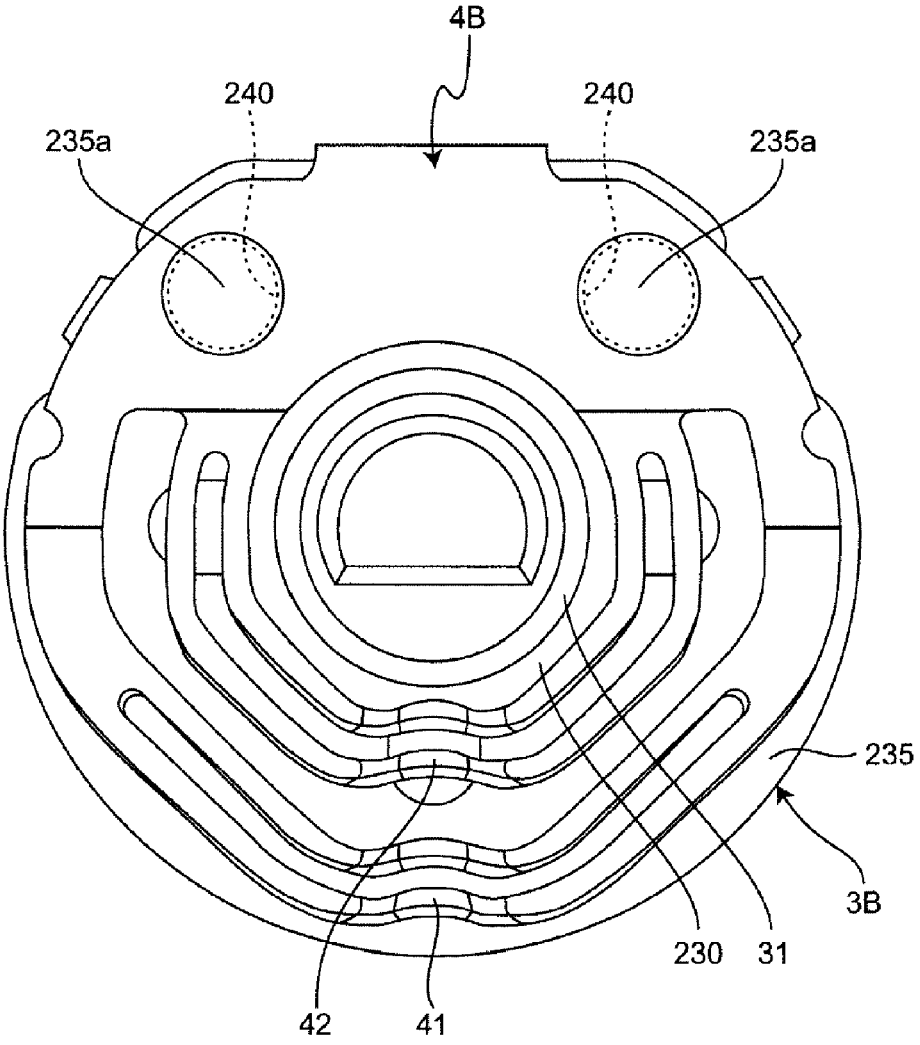
FIG. 16 is a plan view illustrating a rotor and a slider when viewed from the lower side according to a third preferred embodiment of the present invention.
Figure 17:
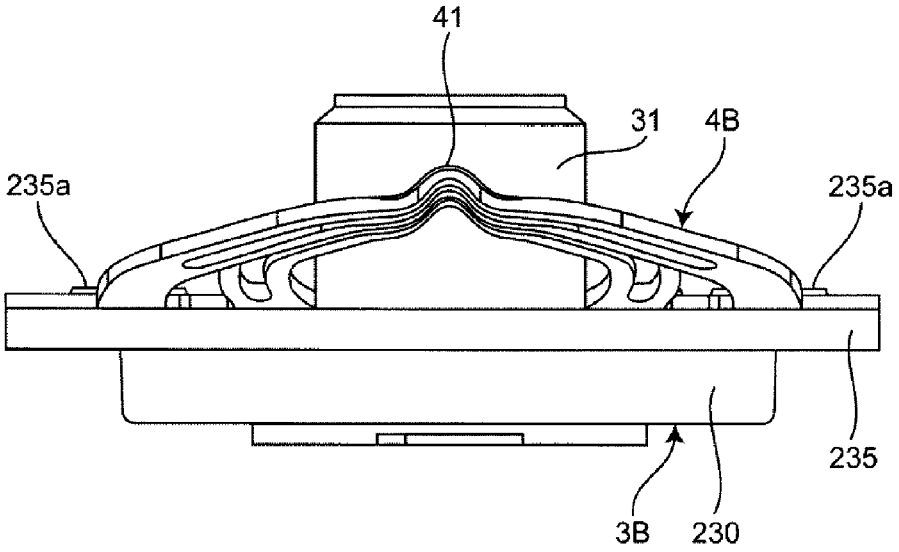
FIG. 17 is a side view illustrating the rotor and the slider.
Figure 18:
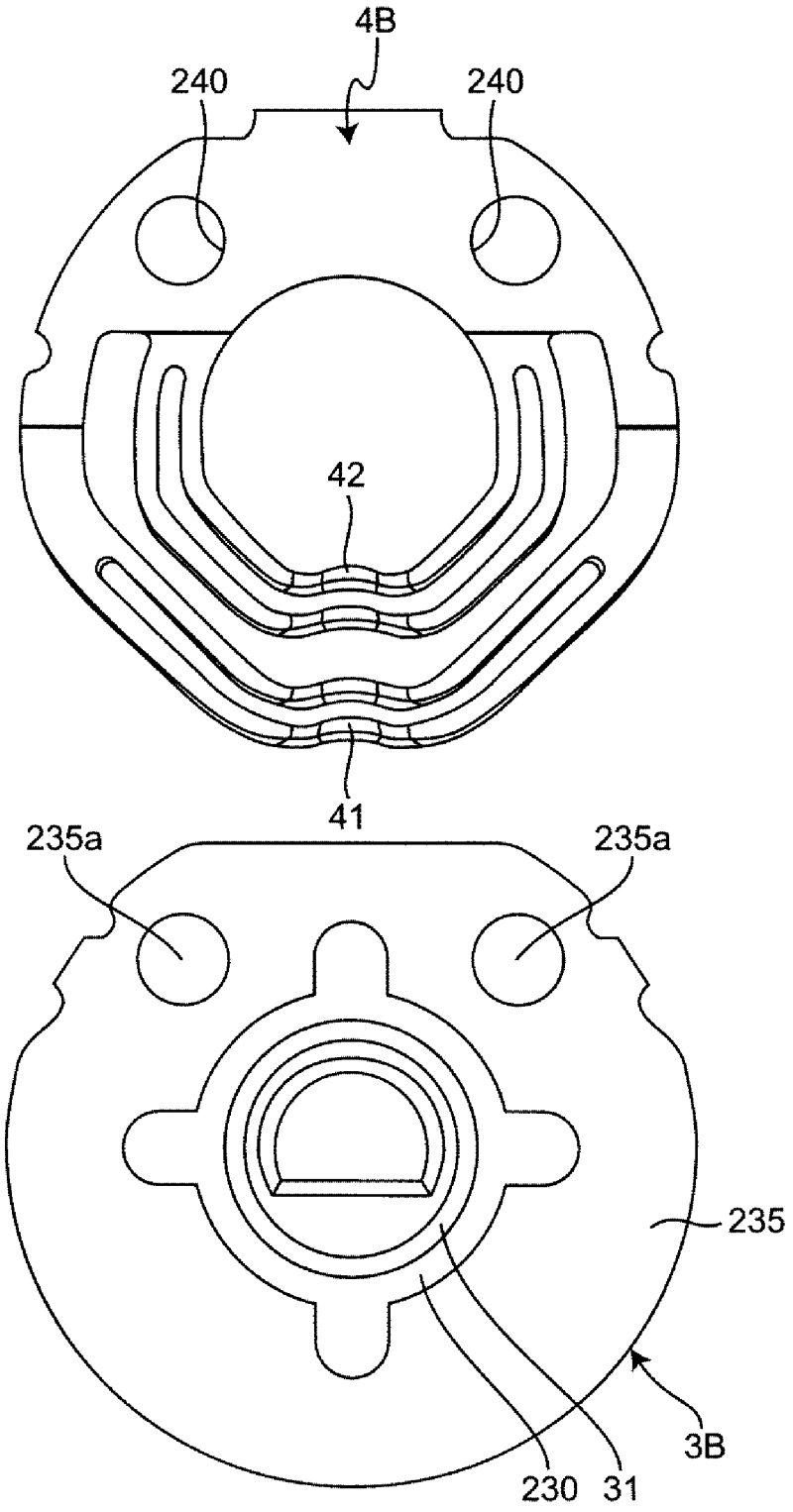
FIG. 18 is a plan view illustrating a state in which the rotor and the slider are exploded.

FIG. 16 is a plan view illustrating a rotor and a slider when viewed from the lower side according to a third preferred embodiment of the present invention. FIG. 17 is a side view illustrating the rotor and the slider. FIG. 18 is a plan view illustrating a state in which the rotor and the slider are exploded. The third preferred embodiment is different from the second preferred embodiment in the configuration of a metal member.

As illustrated in FIG. 16, FIG. 17, and FIG. 18, a rotor 3B includes a main body 230 including a boss 31 and made of resin and a metal member 235 fixed to the main body 230. The slider 4B is locked by the metal member 235 and is mounted on the rotor 3B. The slider 4B is locked by the metal member 235 by bending and fixing of the metal member 235. The metal member 235 is fixed to the main body 230 by insert molding.

As is described specifically, the metal member 235 is defined by a disc-shaped metal plate. The outer shape of the metal member 235 has the same or substantially the same size as that of the outer shape of the slider 4B when seen from the above. The metal member 235 is fixed to the main body 230 by the insert molding. The metal member 235 includes two projections 235*a*. The projections 235*a* of the metal member 235 are inserted into holes 240 of the slider 4B to be held. The slider 4B is locked by the metal member 235 by fixing of the projections 235*a* of the metal member 235.

Figure 19A:
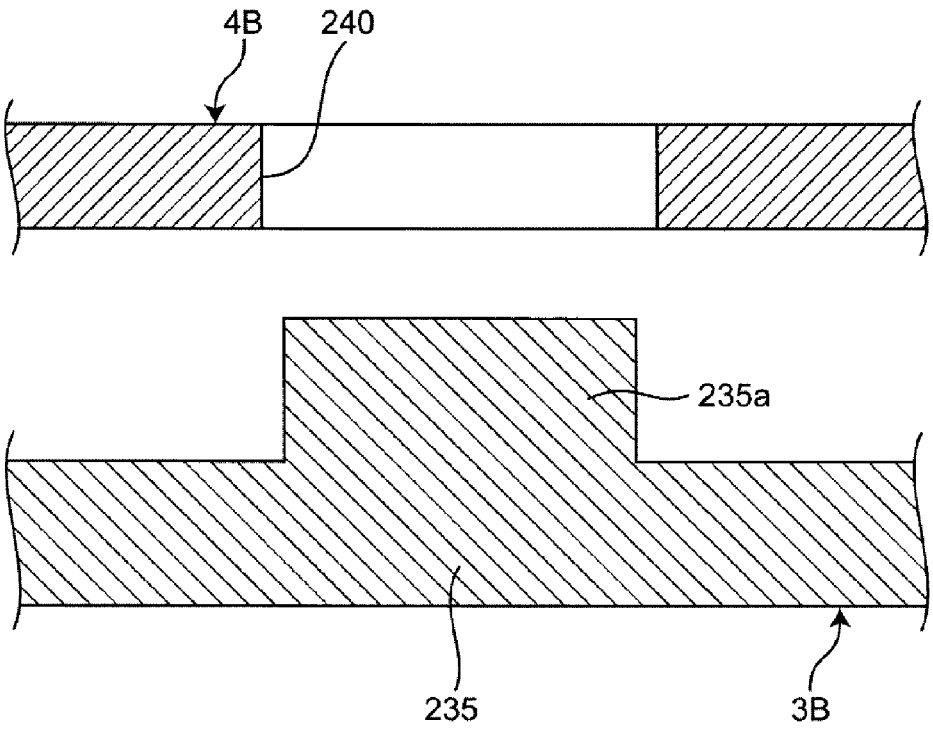
FIGS. 19A and 19B are descriptive views for explaining a method for fixing the slider to the rotor.
Figure 19B:
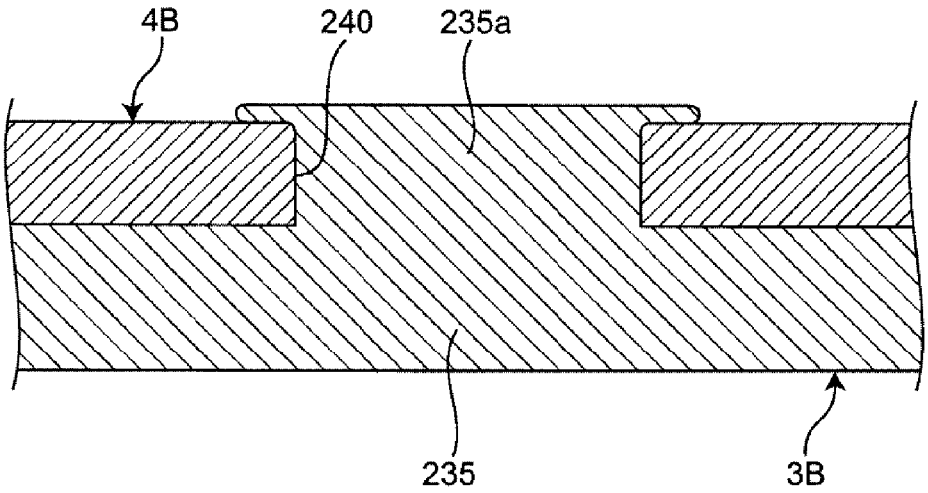

Next, a method for fixing the slider 4B to the rotor 3B is described. As illustrated in FIG. 19A, the slider 4B is installed on the metal member 235 of the rotor 3B. In this case, the projections 235*a* of the metal member 235 of the rotor 3B are inserted into the holes 240 of the slider 4B. Thereafter, as illustrated in FIG. 19B, the projections 235*a* of the metal member 235 are crushed to fix the slider 4B to the metal member 235.

The third preferred embodiment achieves the same effects as those provided by the second preferred embodiment. Furthermore, the metal member 235 having the same or substantially the same size as that of the slider 4B is able to be fixed to the main body 230 and fixing of the metal member 235 to the main body 230 is therefore stable. With this, the slider 4B is fixed to the rotor 3B securely and reliably.

It should be noted that the present invention is not limited to the above-described preferred embodiments and design can be changed in a range without departing from the gist of the present invention.

Although the outer shape of the resistor pattern is preferably the circular shape in the above-described preferred embodiments, the outer shape of the resistor pattern may be an ellipse, a square, or other polygonal shapes, for example.

Although the sizes of the openings of the holes of the screen film preferably vary in the printing direction (first direction X) in the above-described preferred embodiments, the sizes of the openings of the holes of the screen film may be constant in the printing direction.

Although the upper surface of the insulating substrate preferably is the flat surface and the upper surface of the resistor pattern is the recessed surface in the above-described preferred embodiments, the upper surface of the insulating substrate may be a projecting surface and the upper surface of the resistor pattern may be a flat surface, for example.

Although $1.0 \leq (t2/t1) < 1.2$ preferably is satisfied in the top portion of the resistor pattern in the above-described preferred embodiments, $1.0 \leq (t5/t4) < 1.2$ may be satisfied in the side portions of the resistor pattern.

Although $Z \leq 4.0$ and $Z \times L < 10$ are satisfied and $1.0 \leq (t2/t1) < 1.2$ preferably is satisfied in the above-described preferred embodiments, any one of them may be satisfied.

Although the resistor pattern and the current collector pattern preferably are made of the same material in the above-described preferred embodiments, they may be made of different materials.

Although the electrode pattern is preferably provided in the above-described preferred embodiments, the electrode pattern may be omitted.

Although the printing direction (first direction) preferably is set to 0° direction illustrated in FIG. 4 in the above-described preferred embodiments, it may be +90° direction or −90° direction, for example. In this case, the side portions in FIG. 3 correspond to the top portions and the top portion in FIG. 3 corresponds to the side portion. Furthermore, the printing direction may be opposite to the first direction in this case, and the upstream side in the printing direction corresponds to the side at which the length of the resistor pattern in the direction perpendicular or substantially perpendicular to the first direction is maximum.

Although the slider preferably is locked by the metal member by bending and fixing or holding of the metal member in the second and third preferred embodiments, the slider may be locked by the metal member by a method other than bending and fixing or holding of the metal member. Furthermore, although the metal member preferably is fixed to the main body by the insert molding, the metal member may be fixed to the main body by a method other than the inert molding.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A rotary variable resistor comprising:

an insulating substrate;

a resistor pattern and a current collector pattern that are provided on the insulating substrate and are separated from each other;

a rotor that is mounted on the insulating substrate in a rotatable manner; and a slider that is mounted on the rotor so as to be rotatable together with the rotor and to make sliding contact with the resistor pattern and the current collector pattern to cause the resistor pattern and the current collector pattern to be conducted to each other; wherein a maximum dimension of the resistor pattern, which defines a variable resistor, is Z [mm] and electric linearity is L [%]; and $Z \leq 4.0$ and $Z \times L < 10$ are satisfied.

2. The rotary variable resistor according to claim 1, wherein the resistor pattern and the current collector pattern are made of a screen-printed paste on the insulating substrate.

3. The rotary variable resistor according to claim 1, wherein the resistor pattern and the current collector pattern are made of a same material.

4. The rotary variable resistor according to claim 1, further comprising:

an exposed electrode that is provided in the insulating substrate and is exposed at a surface of the insulating substrate; and an electrode pattern that is provided on the insulating substrate and is located between the resistor pattern and the exposed electrode; wherein the resistor pattern and the exposed electrode are conducted to each other with the electrode pattern interposed between the resistor pattern and the exposed electrode.

5. The rotary variable resistor according to claim 1, wherein the rotor includes:

a main body made of resin; and a metal member fixed to the main body; wherein the slider is locked by the metal member and is mounted on the rotor.

6. The rotary variable resistor according to claim 5, wherein the slider is locked by the metal member by bending and fixing or holding of the metal member.

7. The rotary variable resistor according to claim 5, wherein the metal member is insert molded to be fixed to the main body.

8. A rotary variable resistor comprising:

an insulating substrate;

a resistor pattern and a current collector pattern that are provided on the insulating substrate and are separated from each other;

a rotor that is mounted on the insulating substrate in a rotatable manner; and a slider that is mounted on the rotor so as to be rotatable together with the rotor and to make sliding contact with the resistor pattern and the current collector pattern to cause the resistor pattern and the current collector pattern to be conducted to each other; wherein the resistor pattern is made of a screen-printed paste on the insulating substrate extending in a first direction; and on a cross section that passes through a middle point of a width of the resistor pattern at a side at which a length of the resistor pattern in a direction perpendicular or substantially perpendicular to the first direction is maximum on a first straight line in parallel or substantially in parallel with the first direction and passing through a rotating axis of the rotor and is perpendicular or substantially perpendicular to the first straight line;

a film thickness of a center portion is t1 and a maximum film thickness is t2; and $1.0 \leq (t2/t1) < 1.2$ is satisfied.

9. The rotary variable resistor according to claim 8, wherein a maximum dimension of the resistor pattern, which defines a variable resistor, is Z [mm] and electric linearity is L [%], $Z \leq 4.0$ and $Z \times L < 10$ are satisfied.

10. The rotary variable resistor according to claim 8, wherein the resistor pattern and the current collector pattern are made of a same material.

11. The rotary variable resistor according to claim 8, further comprising:

an exposed electrode that is provided in the insulating substrate and is exposed at a surface of the insulating substrate; and an electrode pattern that is provided on the insulating substrate and is located between the resistor pattern and the exposed electrode; wherein the resistor pattern and the exposed electrode are conducted to each other with the electrode pattern interposed between the resistor pattern and the exposed electrode.

12. The rotary variable resistor according to claim 8, wherein the rotor includes:

a main body made of resin; and a metal member fixed to the main body; wherein the slider is locked by the metal member and is mounted on the rotor.

13. The rotary variable resistor according to claim 12, wherein the slider is locked by the metal member by bending and fixing or holding of the metal member.

14. The rotary variable resistor according to claim 12, wherein the metal member is insert molded to be fixed to the main body.

15. A method for manufacturing a rotary variable resistor comprising:

arranging a screen film including holes, which correspond to a resistor pattern and a current collector pattern, on an insulating substrate so as to be separated from the insulating substrate;

placing paste onto the screen film; and forming the resistor pattern and the current collector pattern on the insulating substrate by transporting the paste on the screen film in a first direction while pressing the screen film by a squeegee and pushing out the paste from the holes of the screen film; wherein in the pattern forming, the resistor pattern and the current collector pattern are formed on the insulating substrate while pressing the screen film by the squeegee so as to make the screen film contact with the insulating substrate.

16. The method according to claim 15, wherein a maximum dimension of the resistor pattern, which defines a variable resistor, is Z [mm] and electric linearity is L [%]; and $Z \leq 4.0$ and $Z \times L < 10$ are satisfied.

17. The method according to claim 15, wherein on a cross section that passes through a middle point of a width of the resistor pattern at a side at which a length of the resistor pattern in a direction perpendicular or substantially perpendicular to the first direction is maximum on a first straight line in parallel or substantially in parallel with the first direction and passing through a rotating axis of the rotor and is perpendicular or substantially perpendicular to the first straight line;

a film thickness of a center portion is t1 and a maximum film thickness is t2; and $1.0 \leq (t2/t1) < 1.2$ is satisfied.

* * * * *